US008313012B2

(12) United States Patent
Shima et al.

(10) Patent No.: US 8,313,012 B2
(45) Date of Patent: Nov. 20, 2012

(54) ELECTRIC DRIVING MACHINE

(75) Inventors: Yukihiro Shima, Hitachinaka (JP); Masahiro Inaniwa, Hitachinaka (JP); Hiroyuki Oda, Hitachinaka (JP); Takashi Ueda, Hitachinaka (JP); Yoshihiro Nakano, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 189 days.

(21) Appl. No.: 12/438,730

(22) PCT Filed: Sep. 14, 2007

(86) PCT No.: PCT/JP2007/068494

§ 371 (c)(1),
(2), (4) Date: Feb. 24, 2009

(87) PCT Pub. No.: WO2008/032882

PCT Pub. Date: Mar. 20, 2008

(65) Prior Publication Data

US 2010/0237124 A1 Sep. 23, 2010

(30) Foreign Application Priority Data

Sep. 14, 2006 (JP) ..... 2006-248833

(51) Int. Cl.
*B25C 1/06* (2006.01)

(52) U.S. Cl. ..... 227/8; 227/2; 227/129; 227/131; 227/333; 173/117; 173/216; 173/2

(58) Field of Classification Search ..... 227/8, 2, 227/129, 131, 133; 173/117, 216, 2
See application file for complete search history.

(56) References Cited

U.S. PATENT DOCUMENTS

| | | | | |
|---|---|---|---|---|
| 5,605,268 | A * | 2/1997 | Hayashi et al. | 227/8 |
| 6,796,475 | B2 | 9/2004 | Adams | |
| 6,997,367 | B2 * | 2/2006 | Hu | 227/132 |
| 2005/0217874 | A1 | 10/2005 | Forster et al. | |
| 2005/0217875 | A1 * | 10/2005 | Forster et al. | 173/1 |
| 2006/0283910 | A1 * | 12/2006 | Schiestl et al. | 227/131 |

FOREIGN PATENT DOCUMENTS

| | | |
|---|---|---|
| JP | 08-205573 | 8/1996 |
| JP | 2004-074295 A | 3/2004 |
| JP | 2004-523995 T | 8/2004 |
| JP | 2005-066822 A | 3/2005 |
| JP | 2006-130592 A | 5/2006 |

OTHER PUBLICATIONS

Japanese Notification of Reasons for Refusal, w/ English transaction thereof, issued in Japanese Patent Application No. JP 2006-248833 dated Jul. 9, 2010.

* cited by examiner

*Primary Examiner* — Brian D Nash
*Assistant Examiner* — Michelle Lopez
(74) *Attorney, Agent, or Firm* — McDermott Will & Emery LLP

(57) ABSTRACT

A controller 50 has a single-driving mode/continuous-driving mode changeover switch 233 for performing fastener driving operation in a single driving mode or a continuous driving mode. In a case where the single-driving mode/continuous-driving mode changeover switch 233 instructs a single driving mode, the controller 50 causes a driver blade 3*a* to perform fastener driving operation when both a trigger switch 5 and a push lever switch 22 are switched, by switching operation, from the one switch status to the other switch status (e.g., the ON status). Consequently, fastener driving operation is made possible regardless of sequence of actuation of the trigger switch 5 and the push lever switch 22.

4 Claims, 18 Drawing Sheets

(CLUTCH IS DISENGAGED)

(CLUTCH IS DISENGAGED)

(CLUTCH IS ENGAGED)

(CLUTCH IS ENGAGED)

FIG. 10

OPERATION TABLE OF POWER CONTROL CIRCUIT 408

| OPERATION POINT IN TIME | OPERATING STATUS OF SW ELEMENT 211 | OPERATING STATUS OF POWER SWITCH 210 | OUTPUT STATUS OF INVERTER 207 | OUTPUT STATUS OF INVERTER 215 | D-TYPE FF 209 | | | OPERATING STATUS OF SW ELEMENT 219 |
|---|---|---|---|---|---|---|---|---|
| | | | | | RES INPUT STATUS | CK INPUT STATUS | Q OUTPUT STATUS | |
| 1 WHEN BATTERY PACK IS LOADED | OFF | OFF | L | H | H | L | L | OFF |
| 2 MAKE SWITCHING TO OPERABLE MODE | OFF | ON | H | L | L | H | H | ON |
| 3 MAKE SWITCHING TO LOW POWER CONSUMPTION MODE | OFF | ON | H | L | L | H | L | OFF |
| 4 MAKE SWITCHING TO OPERABLE MODE AGAIN | OFF | ON | H | L | L | H | H | ON |
| 5 LEAVE OPERABLE MODE FOR PREDETERMINED PERIOD OF TIME (LOW POWER CONSUMPTION MODE) | ON | OFF | H | L | L | H | L | OFF |

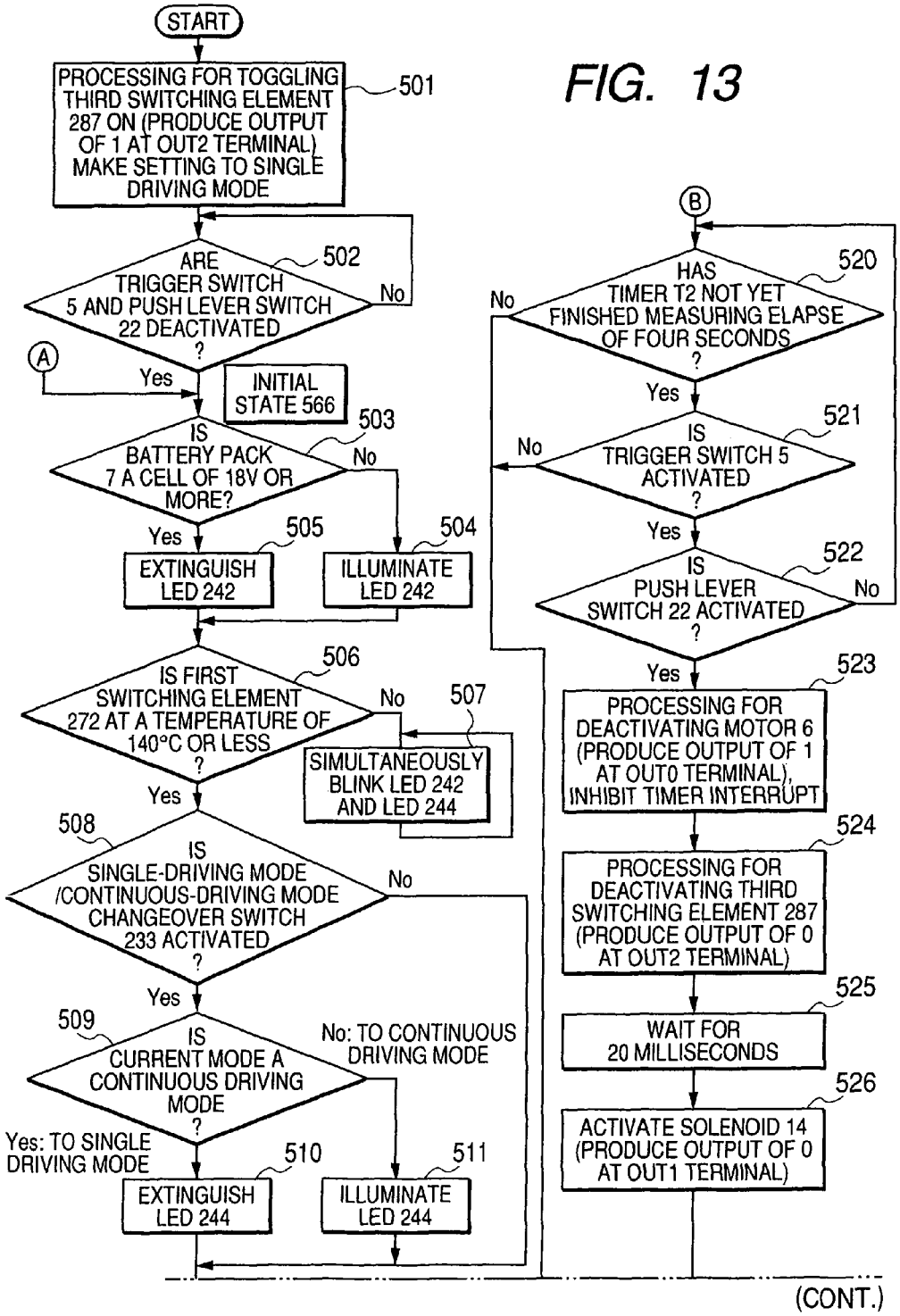
FIG. 13
START
PROCESSING FOR TOGGLING THIRD SWITCHING ELEMENT 287 ON (PRODUCE OUTPUT OF 1 AT OUT2 TERMINAL) MAKE SETTING TO SINGLE DRIVING MODE
501
ARE TRIGGER SWITCH 5 AND PUSH LEVER SWITCH 22 DEACTIVATED ?
502
No
A
Yes
INITIAL STATE 566
IS BATTERY PACK 7 A CELL OF 18V OR MORE?
503
No
Yes
EXTINGUISH LED 242
505
ILLUMINATE LED 242
504
IS FIRST SWITCHING ELEMENT 272 AT A TEMPERATURE OF 140°C OR LESS ?
506
No
507
SIMULTANEOUSLY BLINK LED 242 AND LED 244
Yes
IS SINGLE-DRIVING MODE /CONTINUOUS-DRIVING MODE CHANGEOVER SWITCH 233 ACTIVATED ?
508
No
Yes
IS CURRENT MODE A CONTINUOUS DRIVING MODE ?
509
No: TO CONTINUOUS DRIVING MODE
Yes: TO SINGLE DRIVING MODE
EXTINGUISH LED 244
510
ILLUMINATE LED 244
511
B
HAS TIMER T2 NOT YET FINISHED MEASURING ELAPSE OF FOUR SECONDS ?
520
No
Yes
IS TRIGGER SWITCH 5 ACTIVATED ?
521
No
Yes
IS PUSH LEVER SWITCH 22 ACTIVATED ?
522
No
Yes
PROCESSING FOR DEACTIVATING MOTOR 6 (PRODUCE OUTPUT OF 1 AT OUT0 TERMINAL), INHIBIT TIMER INTERRUPT
523
PROCESSING FOR DEACTIVATING THIRD SWITCHING ELEMENT 287 (PRODUCE OUTPUT OF 0 AT OUT2 TERMINAL)
524
WAIT FOR 20 MILLISECONDS
525
ACTIVATE SOLENOID 14 (PRODUCE OUTPUT OF 0 AT OUT1 TERMINAL)
526
(CONT.)

(FIG. 13 CONTINUED)
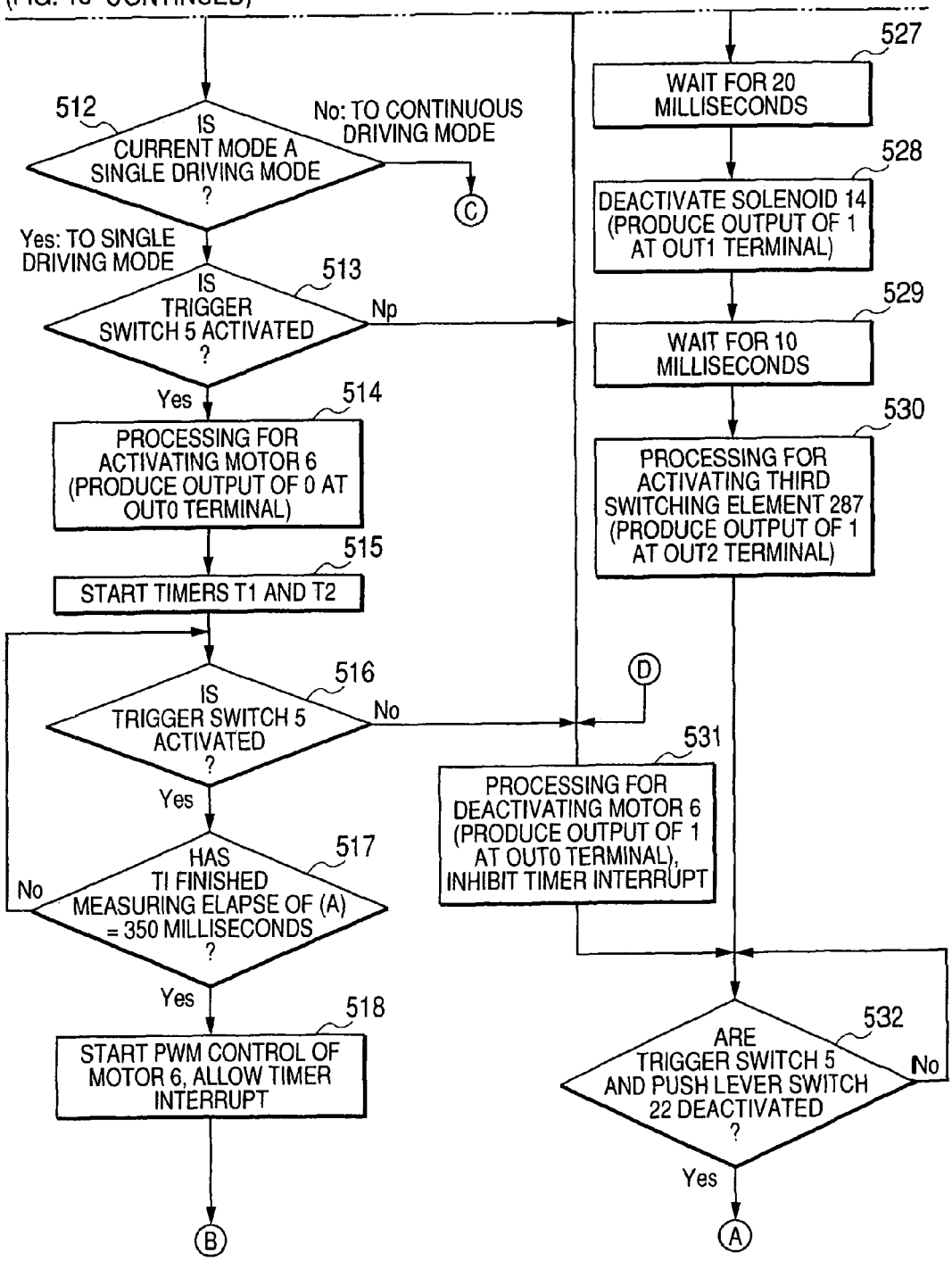

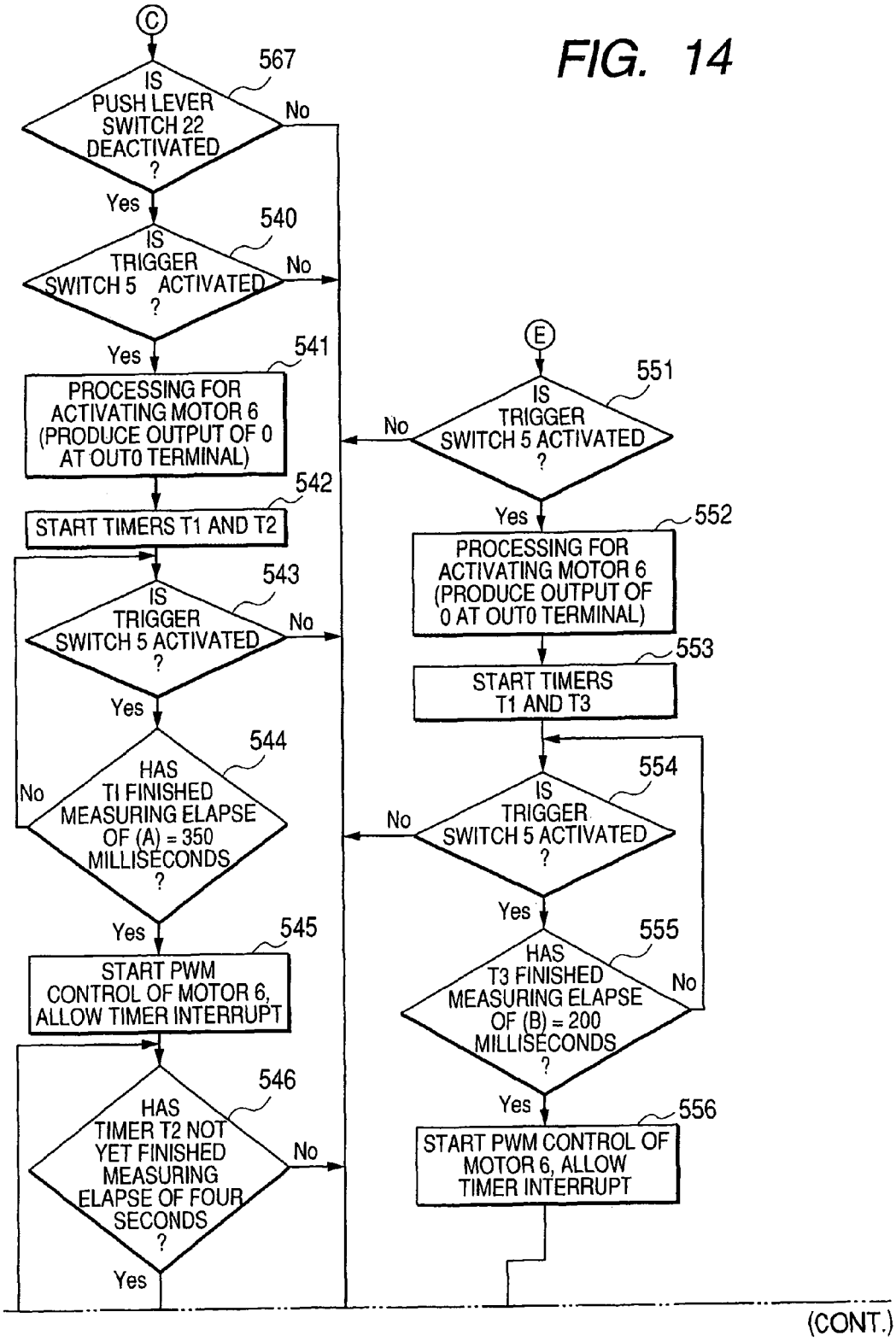
(CONT.)

(FIG. 14 CONTINUED)
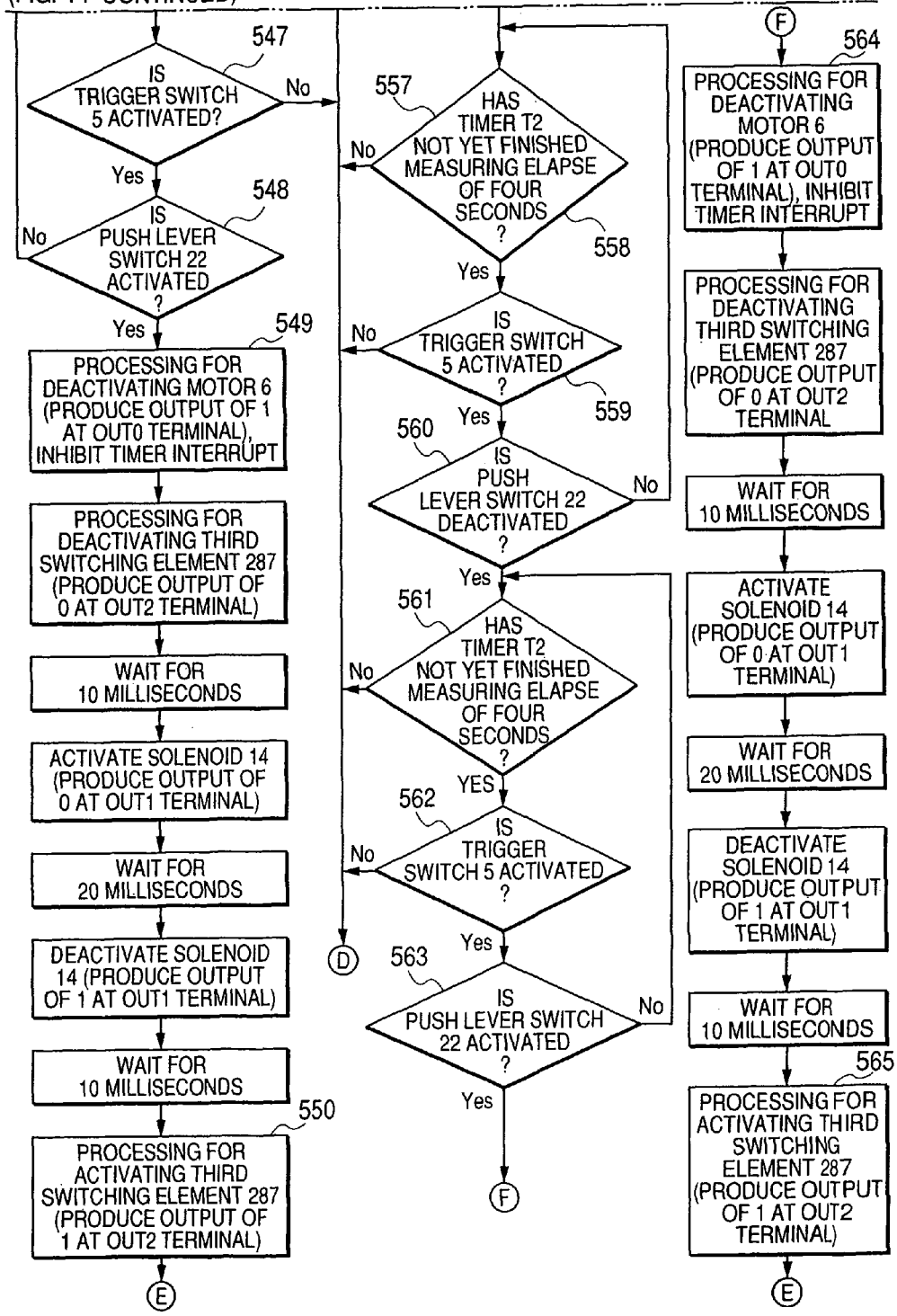

(FIG. 15 CONTINUED)
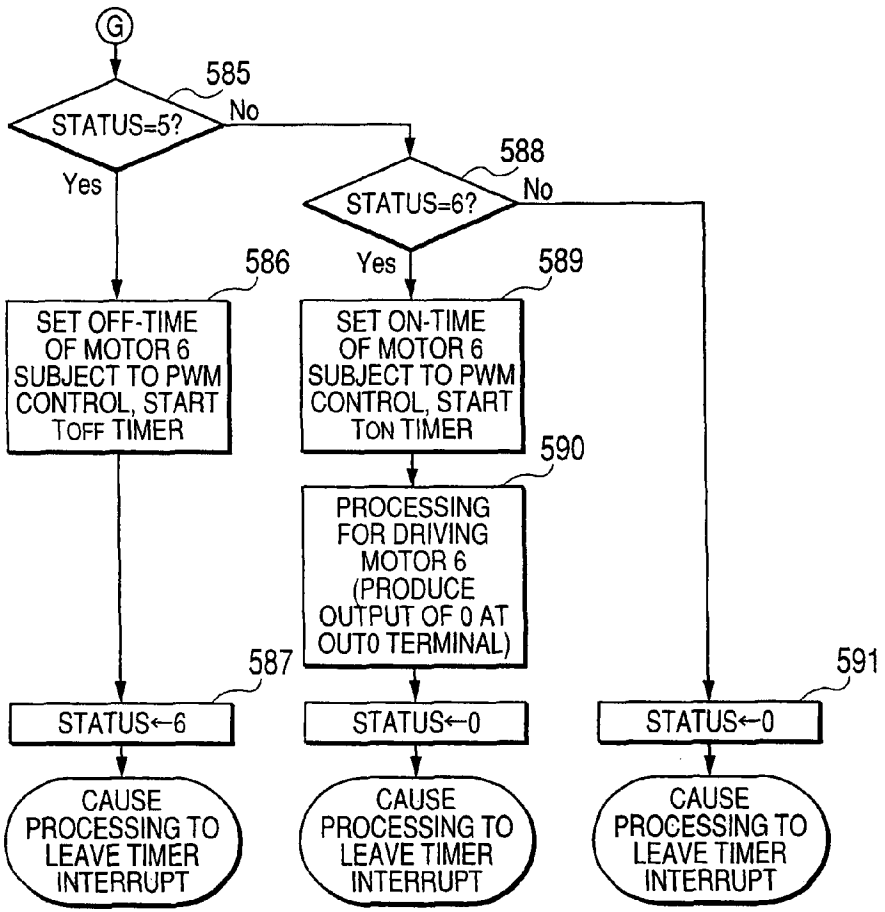

ELECTRIC DRIVING MACHINE

TECHNICAL FIELD

The present invention relates to an electric driving machine which uses a motor as a driving drive source for driving a fastener, such as nails, staples, and the like. The present invention relates particularly to an electric driving machine including a power transmission mechanism—which has a clutch mechanism for transmitting rotational drive force of a motor in the electric driving machine, as rectilinear drive force, to an actuator having a drive blade for driving the fastener—and a controller for controlling operation timing of the motor.

BACKGROUND ART

A pneumatic driving machine—which guides air compressed by an air compressor through use of an air hose and uses the thus-guided air as a power source—is most frequently utilized as a system for driving a common, related-art fastener driving machine, because the driving machine is compact and lightweight. However, the pneumatic driving machine suffers a problem of workability being impaired by the hose which supplies compressed air to the driving machine from the air compressor and which always accompanying the driving machine. Further, a heavy air compressor must be carried in conjunction with the pneumatic driving machine, and hence great inconvenience is encountered in moving and installing the air compressor.

It is disclosed by, for example JP-A-8-205573, that an electric driving machine has been proposed in place of the pneumatic driving machine, wherein a battery (a battery pack) is taken as an energy source and which converts rotational energy of a flywheel rotationally driven by an electric motor into rectilinear kinetic energy used for driving a fastener. This electric driving machine rotates the flywheel by the electric motor, and transmits the rotational energy to a fastener driving mechanism section by a transmission mechanism, such as a clutch, thereby driving a fastener.

DISCLOSURE OF THE INVENTION

This electric driving machine generally has a trigger switch and a push lever switch which can be operated from an OFF state (one switch status) to an ON state (another switch status). The trigger switch is actuated during fastener driving operation, and the push lever switch is operated in order to adjust a fastener driving timing. Moreover, the driving machine is configured so as to start driving a fastener after a microcomputer constituting a control circuit has determined a switch output signal responsive to operation of the trigger switch and operation of the push lever switch and determined that both of these switches are activated (or deactivated.

A period of hundreds of milliseconds is required to acquire the amount of kinetic rotation energy necessary to rotationally drive a stationary flywheel to a predetermined rotational speed by an electric motor, to thus drive a fastener. Therefore, by control operation for rotating the electric motor by actuation of the trigger switch, to thus accumulate energy required for driving in the flywheel, and commencing driving operation in response to actuation of the push lever switch, quick driving operation for enabling driving at a desired time becomes feasible. However, in the case of this control operation, since fastener driving operation is started in response to actuation of the push lever switch, difficulty is encountered in aiming operation for accurately driving a fastener into a target location on a workpiece.

Therefore, one object of the present invention is to provide an electric driving machine which enables fastener driving operation in conformance with the mode of operation of switches; namely, a trigger switch and a push lever switch.

Another object of the present invention is to provide an electric driving machine which exhibits high working efficiency and enables fastener driving operation appropriate for a single-driving mode.

Among inventions described in order to solve the problem, a typical invention is summarized as follows.

According to one characteristic of the present invention, there is provided an electric driving machine comprising:

a motor for rotating a flywheel;

actuator feeding means which converts rotational drive force of the flywheel into rectilinear drive force and transmits the rectilinear drive force to a driver blade which drives a fastener;

a power transmission section for transmitting the rotational drive force of the flywheel to the actuator feeding means or interrupting transmission of the rotational drive force;

engagement/disengagement means for controlling the power transmission section in an engaged status or a disengaged status;

a battery pack provided as a source for supplying electric power to the motor and the engagement/disengagement means;

a trigger switch and a push lever switch which can be actuated so as to be switched from one switch status to another switch status; and a controller which controls supply of power from the battery pack to the motor and the engagement/disengagement means in response to switching of the trigger switch and the push lever switch, thereby enabling the driver blade to drive a fastener, wherein the controller has a single-driving mode/continuous-driving mode changeover switch for performing fastener driving operation in a single driving mode or a continuous driving mode; and, in a case where the single-driving mode/continuous-driving mode changeover switch instructs a single driving mode, the controller causes the driver blade to perform fastener driving operation when both the trigger switch and the push lever switch are switched from the one switch status to the other switch status.

According to another characteristic of the present invention, the controller has a first switching element for connecting or disconnecting a power supply from the battery pack to the motor and a second switching element for connecting or disconnecting a power supply from the battery pack to the engagement/disengagement means. The controller activates the first switching element when the trigger switch has been switched to the other switch status, to thus supply power to the motor, and subsequently switches the push lever switch to the other switch status to activate the second switching element and bring the engagement/disengagement means into an engaged status, thereby causing the driver blade to perform fastener driving operation.

According to still another characteristic of the present invention, the controller has a first switching element for connecting or disconnecting a power supply from the battery pack to the motor and a second switching element for connecting or disconnecting a power supply from the battery pack to the engagement/disengagement means. When having switched the trigger switch to the other switch status after switching of the push level switch to the other switch status, the controller activates the first switching element simultaneously with switching of the trigger switch to the other switch status, and subsequently activates the second switching element to bring the engagement/disengagement means into an engaged state, thereby causing the driver blade to perform fastener driving operation.

According to yet another characteristic of the present invention, the controller supplies power to the motor at a point in time when the trigger switch has been switched to the other switch status, and brings the engagement/disengagement means into the engaged status after elapse of a predetermined period of time, thereby causing the driver blade to perform fastener driving operation.

In the present invention, either a momentary-on switch (i.e., a normally-off switch) or a momentary-off switch (i.e., a normally-on switch) can be used for the trigger switch and the push lever switch. In descriptions of an embodiment provided below, a momentary-on switch is applied.

ADVANTAGES OF THE INVENTION

According to the present invention, the driver blade drives a fastener when the trigger switch and the push lever switch are actuated (switched to the other switch status) simultaneously, and hence quick driving operation for driving a fastener at a desired time becomes feasible regardless of sequence of actuation of the trigger switch and the push lever switch. Further, aiming operation for accurately driving a fastener to a target location on a workpiece becomes possible. Accordingly, fastener driving operation conforming to a working style can be performed, which yields an advantage of enhancement of working efficiency.

The above and other objectives of the present invention and the above and other characteristics and advantages of the present invention will become more obvious by reference to the descriptions and accompanying drawings of a patent specification of the present invention provided below.

BRIEF DESCRIPTION OF THE DRAWINGS

FIG. 10 is an operation table of a power control circuit constituting the controller shown in FIG. 9.

FIG. 13 is a first flowchart showing control procedures of the controller shown in FIG. 9.

FIG. 14 is a second flowchart showing control procedures continuous from the first flowchart shown in FIG. 13.

BEST MODE FOR IMPLEMENTING THE INVENTION

Figure 1:
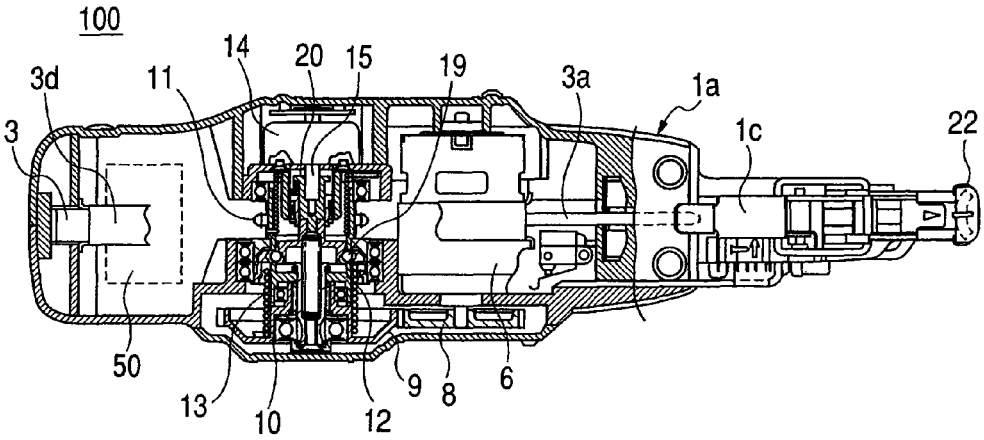
FIG. 1 is a top view of an electric driving machine of an embodiment of the present invention.

An embodiment in which the present invention is applied to an electric driving machine will be described hereunder by reference to the drawings. In addition to including descriptions of characteristics of the present invention, the following descriptions of an embodiment encompass descriptions of characteristics of other inventions in order to facilitate comprehension of the configuration and advantages of an overall electric driving machine of the present embodiment. Throughout the drawings for explanation of the embodiment, members having the same functions are assigned the same reference numerals, and their repeated explanations are omitted.

[Built-up Structure of an Electric Driving Machine]

A built-up structure of an electric driving machine of the embodiment of the present invention will first be described by reference to FIGS. 1 through 8.

Figure 2:
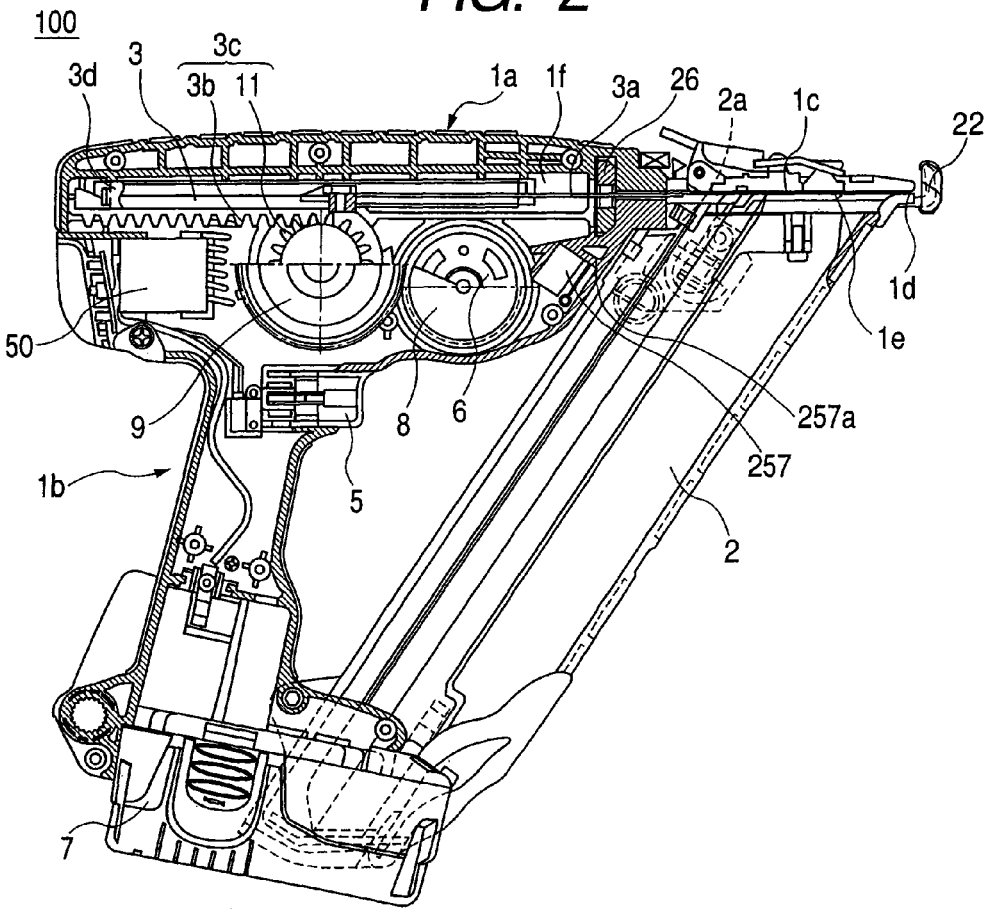
FIG. 2 is a side view of the electric driving machine shown in FIG. 1.

As shown in a top view of FIG. 1 and a side view of FIG. 2, an electric driving machine 100 comprises a main body housing section 1*a* having at the front end thereof a fastener driving section (a nose section) 1*c*; a magazine 2 which is provided in the fastener driving section 1*c* of a main body housing section 1*a* and which continually supplies a fastener (not shown), such as nails, to a path 1*e* of the fastener driving section 1*c*; a handle housing section 1*b* which is joined to and extends downwardly from the main body housing section 1*a*; a trigger switch 5 which is provided in a joint (a junction) of the handle housing section 1*b* and which is actuated at the time of driving of a fastener; a push lever switch 22 which is provided at the extremity of the fastener driving section 1*c* and which is brought into contact with a workpiece, to thus adjust timing for driving a fastener into the workpiece; and a battery pack 7 formed from a battery, such as a lithium ion battery, or the like, connected to the lower end of the handle housing section 1*b*.

Although not illustrated, the magazine 2 is filled with a plurality of joined fasteners (blocks). The joined fasteners remain forced by a spring (not shown) from below the magazine 2 in such a way that the fasteners to be driven into a nose path 1*e* of the fastener driving section 1*c* are sequentially supplied. A remaining fastener sensor 257 formed from a microswitch is provided in association with the magazine 2. The microswitch 257 acting as a remaining fastener sensor has an arm 257*a* which engages with a nail feeding mechanism 2*a* for feeding joined nails (a fastener) provided in the magazine 2; and becomes activated as a result of the arm 257*a* being pushed when the amount of a fastener remaining in the magazine 2 in an aligned manner has become smaller. A remaining fastener detection circuit 406 (see FIG. 9) provided in association with the microswitch 257 will be described later.

Figure 3:
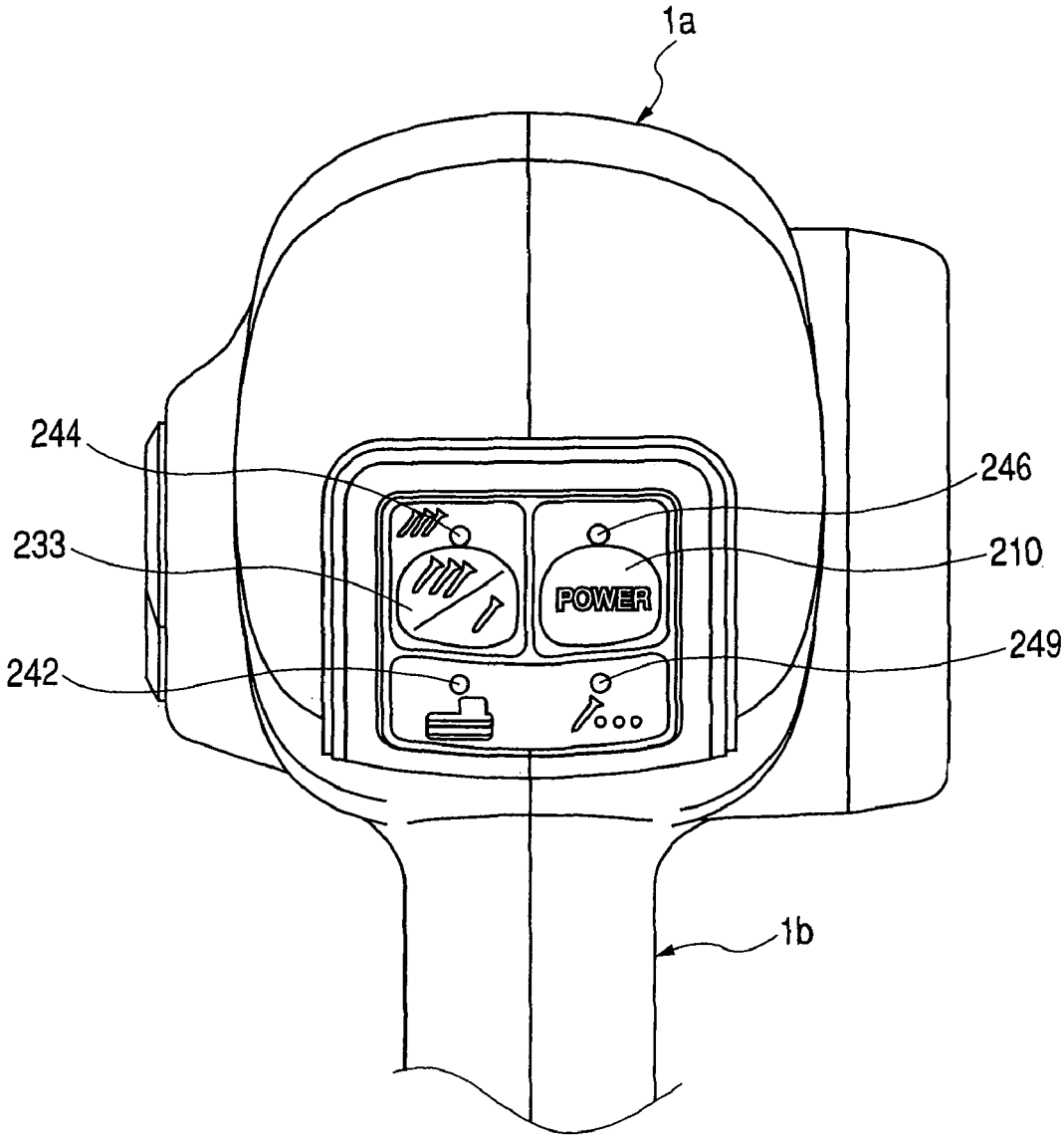
FIG. 3 is an enlarged rear view of the electric driving machine shown in FIG. 1.

As shown in an enlarged rear view of FIG. 3, there are provided on the back of the main body housing 1*a* of the driving machine an LED (light-emitting diode) 244 for use in displaying, in a switchable manner, a single-driving mode or a continuous-driving mode (hereinafter called a "single-driving mode/continuous-driving mode switching display LED"), wherein the LED illuminates in a continuous-driving mode; a power display LED 246 which illuminates when a predetermined source voltage is supplied to a control-system circuit remaining in an operable mode; a battery remaining-power display LED 242 which illuminates when the battery capacity (remaining amount of electric discharge) of the battery pack 7 has become low; and a remaining fastener display LED 249 which illuminates when the amount of a fastener (nails) in the magazine 2 detected by the remaining fastener sensor 257 has become small. Moreover, a single-driving mode/continuous-driving mode changeover switch (a push button switch) 233 and a power switch (a push button switch) 210 for switching between an operable mode and a low-power-consumption mode are further provided on the back of the main body housing 1*a* of the driving machine. Functions of these display sections and those of the switch sections will be described later.

An actuator (plunger) 3 for imparting the force of impact to a fastener fed to the fastener driving section 1*c* is provided in the main body housing section 1*a*. The actuator 3 has a driver blade 3*a* for transmitting the force of impact to the head of a fastener in the nose path 1*e* and a rack 3*b* meshing with a pinion 11 which rotationally moves and will be described later. The rack 3*b* of the actuator 3 and the pinion 11 meshing with the rack 3*b* constitute an actuator feeding mechanism 3*c* which imparts rotational drive force of the pinion 11 to the actuator 3 as rectilinear drive force.

Figure 4:
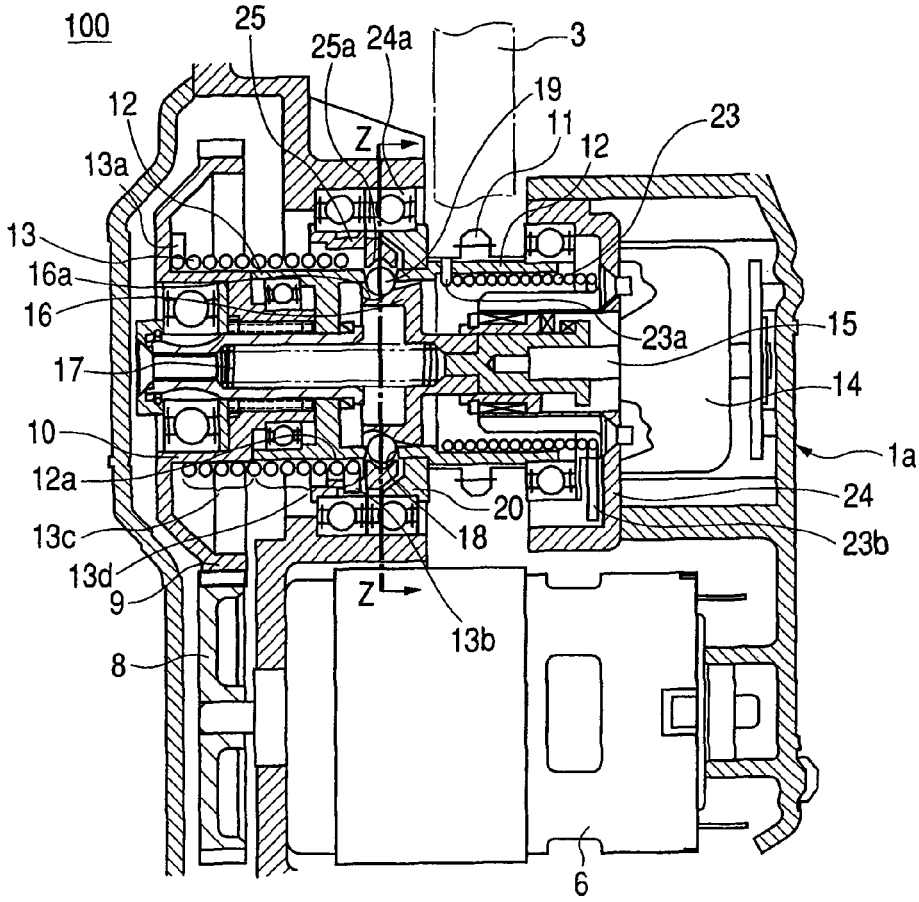
FIG. 4 is an enlarged top view of a power transmission section (whose clutch is disengaged) of the electric driving machine shown in FIG. 1.
Figure 5A:
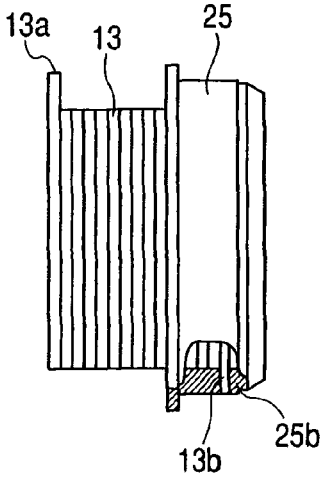
FIGS. 5A and 5B are top views of a coil spring used in the electric driving machine shown in FIG. 4.
Figure 5B:
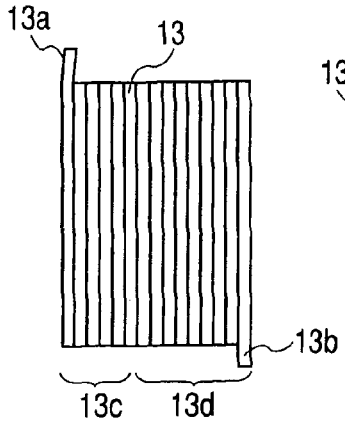
Figure 5C:
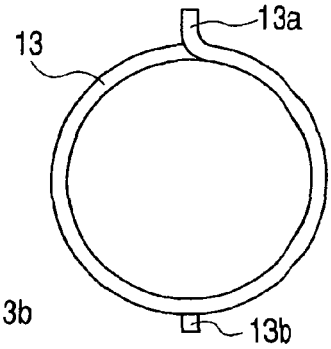
FIG. 5C is a front view of the coil spring used in the electric driving machine shown in FIG. 4.

As shown in FIG. 4, in the main body housing 1*a*, there are provided a motor (a DC commutator motor) 6 which is driven by a d.c. power source formed from the battery pack 7 (see FIG. 2) and which serves as a power source for driving a fastener such as nails; a motor gear 8 fixed to a rotary shaft of the motor 6; a flywheel 9 whose gear meshes with the motor gear 8; a rotational drive shaft 10 rotatably supporting the flywheel 9; a coil spring 13 which encloses an end of the rotational drive shaft 10 and an end (the left end) of a driven rotary shaft 12, both of which are coaxially aligned to each other; and a solenoid 14 serving as engagement/disengagement means (a clutch section) for driving a solenoid drive section (a shaft) 15 in the direction of the rotational axis of the pinion 11. As shown in top views of FIGS. 5A and 5B and a front view of FIG. 5C, the coil spring 13 has a helical shape coiled in an axial direction at a predetermined pitch. As shown in FIG. 4, one end 13*a* of the coil spring 13 is fastened to the rotational drive shaft 10 of the flywheel 9, and a left spring section 13*c* (see FIG. 5B) continuous from the end 13*a* is mechanically connected to the rotational drive shaft 10 while enclosing an outer circumferential surface of the rotational drive shaft 10. Specifically, the left spring section 13*c* is attached to the rotational drive shaft 10 such that the coil spring 13 is rotated when the rotational drive shaft 10 is rotated. At this time, the outer diameter of the rotational driven shaft 12 is determined so as to become smaller than the internal diameter of the coil spring 13 achieved in a natural condition; namely, the outer diameter of the rotational drive shaft 10. Therefore, a right-side coil spring section 13*d* of the coil spring 13 (remains disengaged from) remains out of contact with the driven rotary shaft 12 in the natural condition. The coil spring 13 also rotates in synchronism with rotation of the rotational drive shaft 10. However, the driven rotary shaft 12 does not rotate. Meanwhile, the other end section 13*b* of the coil spring 13 is inserted into a through hole 25*b* of a clutch ring 25 as shown in FIG. 5A, to thus be attached to the clutch ring 25. Along with rotation of the coil spring 13, the clutch ring 25 also rotates.

As shown in FIG. 4, an impelling member 16 having a tapered groove section 16*a* and a solenoid return spring 17 are provided at an end of the solenoid drive section 15. The impelling member 16 and the solenoid return spring 17 are provided on the inner circumferential surface of the cylindrical driven rotary shaft 12. Moreover, an actuator return spring 23 is provided on the inner circumferential surface of the cylindrical driven rotary shaft 12. The cylindrical driven rotary shaft 12 is fixed to one end 23*a* of the actuator return spring 23. A remaining end 23*b* is fixed to a fixed wall section 24 to which the solenoid 14 is attached. Thus, when the driven rotary shaft 12 becomes disengaged from the coil spring 13 after driving of a nail (a fastener), impelling force toward a leading end does not act on the actuator 3. Hence, the actuator 3 is moved toward a trailing end by the actuator return spring 23 and brought into a state achieved before driving of a nail. The impelling member 16, the solenoid return spring 17, and the actuator return spring 23 are provided on the inner circumferential surface of the cylindrical driven rotary shaft 12, thereby making an attempt to miniaturize a power transmission mechanism.

Figure 6:
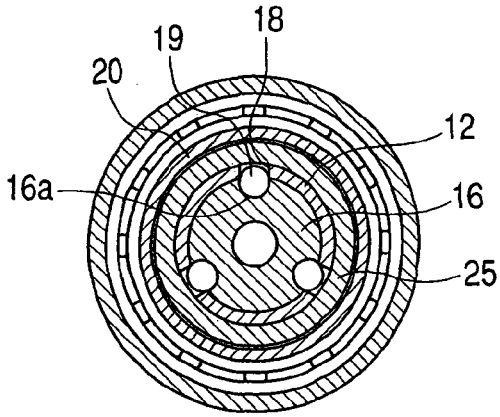
FIG. 6 is a cross-sectional view of the power transmission section (whose clutch is disengaged) taken along line Z-Z shown in FIG. 4.

Further, as shown in FIGS. 4 and 6, three holes 18 are formed in a portion of a circumferential surface of the cylindrical driven rotary shaft 12 at intervals of 120° in the circumferential direction. Balls (steel balls) 19 serving as a spring contact member with respect to the coil spring 13 are provided in the respective holes 18 so as to be movable in a radial direction. The balls 19 are supported, from an inner circumferential surface of the clutch ring 25, by the tapered groove section 16*a* of the impelling member 16 provided in the solenoid drive section 15. A driven rotary shaft support section 20 supporting the driven rotary shaft 12 in a rotatable manner is provided along the direction of an outer circumferential of the balls 19. Thereby, the amount of movement of the balls 19 in the direction of the outer circumferential surface thereof is limited in such a way that the balls 19 are always caught by the holes 18 of the driven rotary shaft 12 in the rotational direction of the driven rotary shaft 12. As shown in FIG. 4, the essentially-annular clutch ring 25 (see FIG. 5A) is fitted coaxially around the driven rotary shaft 12 with nominal clearance with respect to the driven rotary shaft 12. The annular driven rotary shaft support section 20 fits around the driven rotary shaft 12 at a position close to a solenoid 14, which will be described later, when compared with the position of the driven rotary shaft 12 around which the clutch ring 25 is fitted. The annular driven rotary shaft support section 20 is supported by a bearing 24*a* and supports the driven rotary shaft 12.

As shown in FIGS. 4 and 6, an inner diameter of the coil spring 13 achieved in the natural condition (in the disengaged state) is larger than the inner diameter of the driven rotary shaft 12 and smaller than the inner diameter of the rotary drive shaft 10. Therefore, in the natural condition, the coil spring 13 remains out of contact with the driven rotary shaft 12 and contact with the rotary drive shaft 10. In synchronism with rotation of the rotary drive shaft 10, the coil spring 13 and the clutch ring 25 also rotate, but the driven rotary shaft 12 does not rotate. Specifically, there is achieved a disengaged state where the rotational drive force of the rotational drive shaft 10 is not transmitted to the driven rotary shaft 12.

Figure 7:
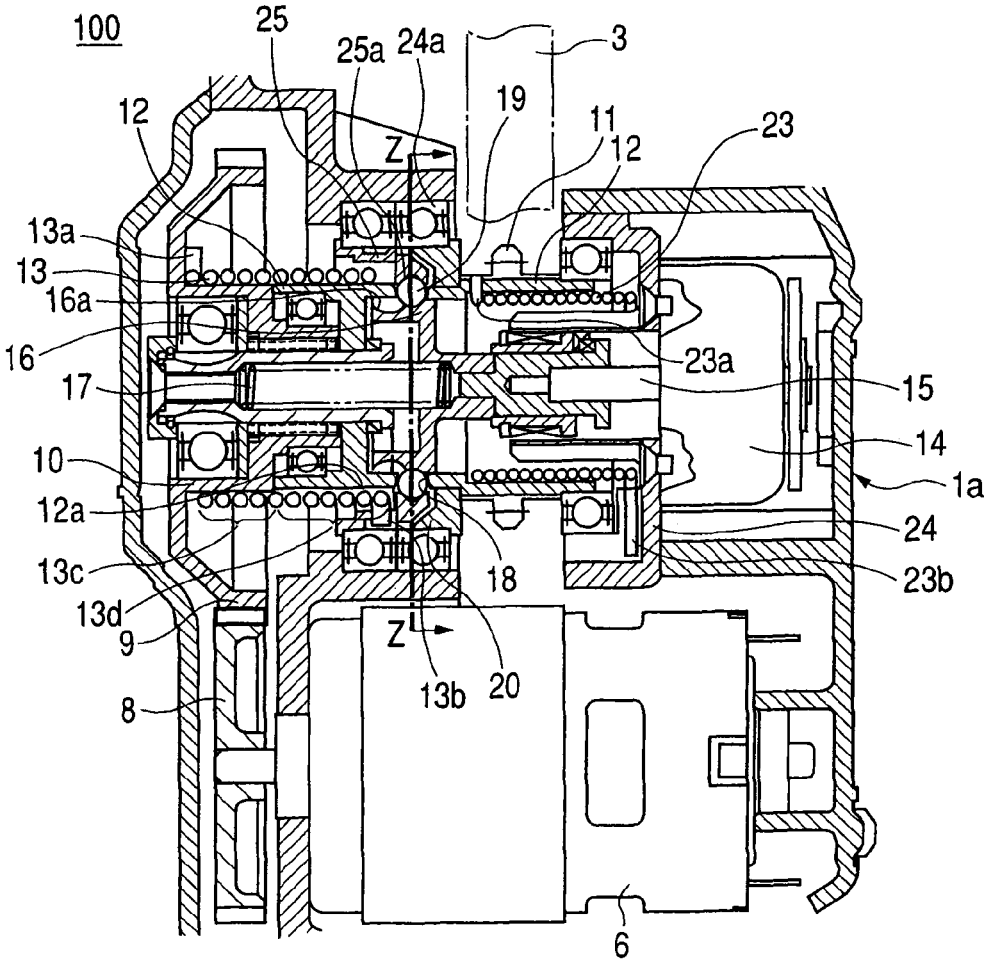
FIG. 7 is an enlarged top view of a power transmission section (whose clutch is engaged) of the electric driving machine shown in FIG. 1.
Figure 8:
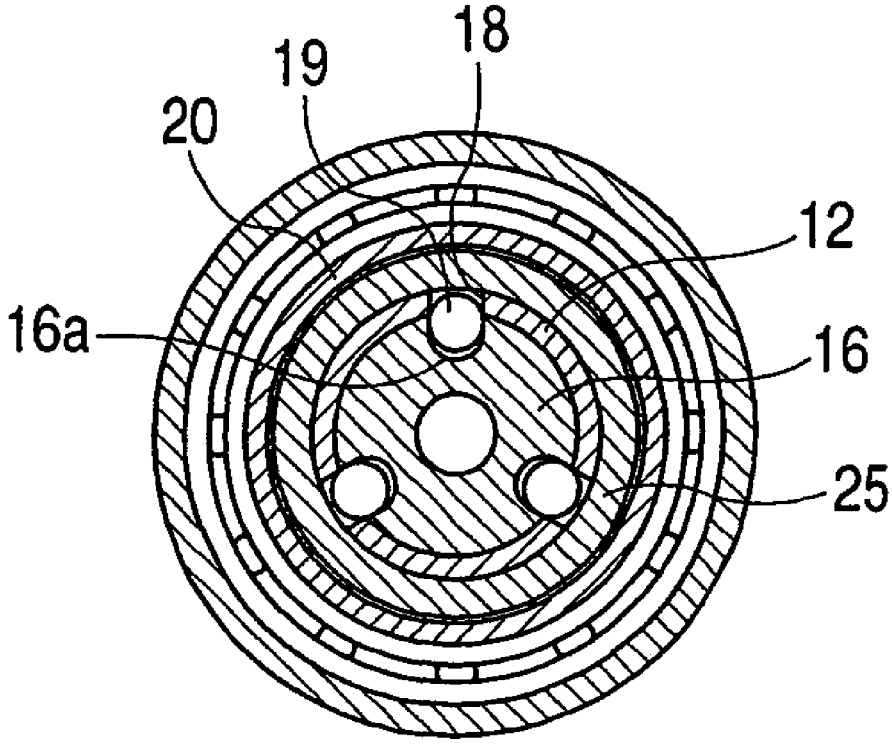
FIG. 8 is a cross-sectional view of the power transmission section (whose clutch is engaged) taken along line Z-Z shown in FIG. 7.

As shown in FIGS. 7 and 8, when an ON-state current has flowed into the solenoid 14 in an engaged state contrary to the above state, the impelling member 16 of the solenoid drive section 15 moves toward the flywheel 9 (the left side of FIG. 7). Hence, the balls 19 are pushed into the holes 18 along the tapered groove section 16*a* of the impelling member 16, to thus protrude from the outer circumferential surface of the driven rotary shaft 12 and to project into a groove section 25*a* (see FIG. 7) formed along the inner circumferential surface of the clutch ring 25. Specifically, the balls 19 move from the deepest portion of the tapered groove 16*a* along a tapered portion thereof, to thus engage with the clutch ring 25. The driven rotary shaft 12 rotatably supported by the driven rotary shaft support section 20 rotates in conjunction with the clutch ring 25. Thus, the right-side spring 13*d* of the rotating coil spring 13 fastens a spring seat section 12*a* formed along an outer circumferential surface of the enclosed driven rotary shaft 12. Hence, the coil spring 13 remaining in contact (connected) with the rotary drive shaft 10 also comes into contact with the spring seat section 12*a* of the driven rotary shaft 12, and rotates the driven rotary shaft 12 in synchronism with rotation of the rotary drive shaft 10. Specifically, in the engaged state where an electric current is supplied to the solenoid 14, the rotational force of the flywheel 9 is transmitted to the pinion 11 constituting the actuator feeding mechanism 3*c* by way of the clutch ring 25 and the coil spring 13. When the pinion 11 has rotationally moved, rotational movement is transformed into linear motion by the rack 3*b* meshing with the pinion 11, and the driver blade 3*a* fixed to the actuator 3 strikes the head of a fastener. After the driver blade 3*a* fixed to the actuator 3 has struck a fastener, the electric current flowing into the solenoid 14 is turned off by control operation such as that will be described later. The coil spring 13 releases mechanical contact (connection) with the spring seat section 12*a* of the driven rotary shaft 12. The actuator return spring 23 formed from, e.g., constant force spring, is connected to the actuator 3. By restoration force of this spring, the position of the actuator feeding mechanism 3*c* (formed from the rack 3*b* and the pinion 11) achieved after driving operation is returned to the position achieved before driving operation. As shown in FIG. 2, a damper section 26 is provided at the right end of a round-trip path if for the actuator 3 in the main body housing section 1*a*. The damper section 26 is provided for absorbing physical impact which develops when the actuator 3 collides with an interior wall of the main body housing section 1*a* during driving of a nail.

By the above configuration, the spring seat section 12*a* of the driven rotary shaft 12 and the coil spring 13 act as a power transmission section which can act so as to cause the flywheel 9 to engage with or disengage from the actuator feeding mechanism 3*c*. The solenoid 14, the impelling member 16, the balls 19, and the clutch ring 25 act as engagement/disengagement means for controlling the power transmission section to an engaged state or a disengaged state. Therefore, the power transmission section can transmit the rotational energy of the flywheel 9 to the actuator feeding mechanism 3*c*. Further, the engagement/disengagement means can bring the power transmission section into an engaged or disengaged state.

The push lever switch 22 is provided at the leading end of the fastener driving section 1*c* of the main body housing section 1*a*. The push lever switch 22 has the function of adjusting the depth to which a fastener is to be driven into a target material and the function of adjusting a timing—at which a fastener is to be driven—along with the trigger switch 5.

A controller (a controlling device) 50 (see FIG. 2)—which controls the rotation of a motor 6, an operation time (an ON time) of the solenoid 14, and the like, in response to operation of the push lever switch 22 and the trigger switch 5—is provided in the main body housing section 1*a*. Although diagrammatically illustrated, the controller 50 includes a circuit board (a module board), semiconductor integrated circuits (ICs) mounted on the circuit board, and various types of electric components, such as a power FET, resistors, capacitors, diodes, and the like. The controller 50 may also be split into a plurality of circuit boards and arranged in a dispersed manner within a housing.

[Circuit Configuration of Controller 50]

The circuit configuration of the controller 50 provided in the main body housing section 1*a* will now be described by reference to FIG. 9. In addition to including a control circuit for outputting a control signal for a microcomputer 228 (see FIG. 2), the controller (controlling device) 50 is assumed to include drive output circuits (a power output circuit), such as a drive circuit for the motor 6 controlled by the control circuit, a drive circuit for the solenoid 14, and an indicator (LED) drive circuit, and other circuits.

<Configuration of the Microcomputer 228>

The microcomputer 228 is provided in order to execute control procedures (routine) for controlling fastener driving operation shown in FIGS. 13 through 15 to be described later. In a word, the microcomputer 228 is provided for controlling rotation of the motor 6 required to drive a fastener, actuation of the solenoid 14, or the like, in accordance with a control input signal from the previously-described push lever switch 22, a control input signal from the trigger switch 5, and other signals. Although unillustrated, the microcomputer 228 has ROM which stores a control program for controlling driving of the motor 6, actuation of the solenoid 14, and other driving operations, and which also stores an ON time when power from a detected counter electromotive voltage of the motor 6 to be described later is supplied to the motor 6; a CPU (central processing unit) having a computing section for executing the control program, and other programs, stored in the ROM; RAM for temporarily storing a work area for the CPU and data pertaining to the counter electromotive voltage input from a motor counter-electromotive-voltage detection circuit; a TIM (timer) including a reference clock signal generator; and other elements.

The microcomputer 228 comprises an input terminal IN0 for receiving a signal output from the trigger switch 5; an input terminal IN1 for receiving a signal output from the single-driving mode/continuous-driving mode changeover switch 233 to be described later; an input terminal IN2 for receiving a signal output from the push lever switch 22; an input terminal IN3 for receiving a signal output from the remaining fastener sensor (switch) 257; an AD conversion input terminal AD0 for receiving an output signal of counter electromotive force (a counter electromotive voltage) of the motor 6; an AD conversion input terminal AD2 for receiving a detection voltage of the battery pack 7; output terminals OUT1 and OUT2 for outputting a control signal for controlling the solenoid 14; an output terminal OUT3 for outputting a reset pulse signal to a counter 240 to be described later; an output terminal OUT4 for outputting a display drive signal to the display LED (a light-emitting diode) 242 and an output terminal OUT5 for outputting a display drive signal to the display LED 244; a source terminal Vcc for supplying a source voltage of about 2.87V; and a reset input terminal RES for supplying a reset signal when power is supplied to the microcomputer 228. A flowchart for controlling the microcomputer 228 will be described later.

<Configuration of a Power Circuit 407>

As mentioned above, the battery pack 7 is formed from; for example, sixe lithium ion cells. Immediately after having been fully charged, the battery pack supplies a battery voltage $V_{BAT}$ of about 21.6V. The battery voltage $V_{BAT}$ of this battery pack 7 is directly utilized as a source voltage for a power output circuit in a drive circuit of the motor 6 including a power FET 272, a drive circuit of the solenoid 14 including a power FET 295, or the like. A noise absorption capacitor 310 is connected in shunt with the battery pack 7. The battery voltage $V_{BAT}$ of the battery pack 7 is supplied, by way of a diode 201, to a switching element 219 (hereinafter sometimes called a "fourth switching element") consisting of a voltage accumulation capacitor 202 and a transistor switch of a power circuit 407. The switching element 219 acts as line switching means interposed between an input line (a line to which an emitter of the switching element 219 is to be connected) of the power circuit 407 and an output line (a line of the source voltage Vcc) of the power circuit 407. The diode 201 acts as a diode for preventing reverse flow of electric charges of the capacitor 202, and prevents a temporary decrease in a voltage input to the power circuit 407, which would otherwise be caused when the battery voltage $V_{BAT}$ of the battery pack 7 is transiently decreased by a heavy current flowing at the startup of the motor 6. Specifically, the diode 201 and the capacitor 202 act as a kind of filter circuit.

The battery voltage $V_{BAT}$ supplied to the capacitor 202 is clamped at a Zener voltage (about 8.6 V) of a Zener diode 203, whereupon a source voltage Vdd of about 12 V is supplied to a capacitor 204. This source voltage Vdd is used for supplying an operation voltage required for a start-up control circuit such as a delay-type flip flop (D-type flip flop) 209 and Schmidt trigger inverters 207 and 215, which will be described later.

The battery voltage $V_{BAT}$ supplied to the emitter of the fourth switching element 219 is supplied to a regulator 223 by way of an emitter-collector path of the fourth switching element 219 and an excessive-current-limiting resistor 220. The emitter-collector path of the fourth switching element 219 is controlled by controlled activation/deactivation of a control switching transistor 231 which is connected to a base circuit of the fourth switching element and will be described later. When the transistor 231 is activated (in an ON state), the fourth switching element 219 is activated, to thus supply the battery voltage $V_{BAT}$ to the input terminal IN of the regulator 223. Conversely, when the transistor 231 is deactivated (in an OFF state), the fourth switching element 219 is deactivated, thereby interrupting supply of the battery voltage $V_{BAT}$ to the input terminal IN of the regulator 223. Accordingly, supply of the battery voltage $V_{BAT}$ to the input terminal IN of the regulator 223 (an operable mode) is controlled by activation/deactivation of the control switch transistor 213 and the fourth switching element 219.

The regulator 223 constitutes a low-voltage power circuit for stepping down the battery voltage $V_{BAT}$(e.g., 21 V) of the battery pack 7 to the source voltage Vcc (e.g., 5 V) which is constant and lower than the battery voltage. Capacitors 222 and 224, which act as coupling capacitors for stabilizing operation, are connected to input and output lines of the regulator 223 in such a way that the capacitor 222 is connected to the input line and that the capacitor 224 is connected to the output line. The regulator 223 makes constant a high battery voltage $V_{BAT}$ input to an input terminal IN of the regulator; and outputs to an output terminal OUT of the regulator a source voltage Vcc which is lower than the source voltage $V_{BAT}$ of the battery pack 7. The source voltage Vcc is used as a power source for operation of the microcomputer 228. In addition, the source voltage Vcc is used as the source voltage Vcc for control system circuits, such as the LEDs 242, 244, 246, and 249, a counter 240, an oscillator circuit OSC 239, operational amplifiers 256 and 276, and the like. Therefore, according to the present invention, when the source voltage Vcc is not desired to be supplied to the control system circuit, such as the microcomputer 228, or the like, in order to bring the controller 50 into a "low power consumption mode (a standby mode)," the fourth switching element 219 is controlled to an OFF state. Conversely, when the source voltage Vcc is desired to be supplied to a control system circuit, such as the microcomputer 228, or the like, in order to bring the controller 50 into an "operable mode," the fourth switching element 219 is controlled to an ON state. An operation stabilization resistor (bias resistor) 218 and a base current limitation resistor 221 are connected to the base circuit of the fourth switching element 219, and the switching transistor 231 for controlling activation/deactivation of the fourth switching element 219 is connected to the base circuit of the fourth switching element 219. The base of the switching transistor 231 is connected to a Q output terminal of the D-type flip-flop 209 which operates as a control circuit, by way of a resistor 232 for limiting a base current. The switching transistor 231 is controlled by a signal (an ON/OFF signal) output from the Q output terminal of the D-type flip-flop 209. The circuit operation of the power circuit 407 and the circuit operation of the power control circuit 408 will be described in detail later.

Figure 9:
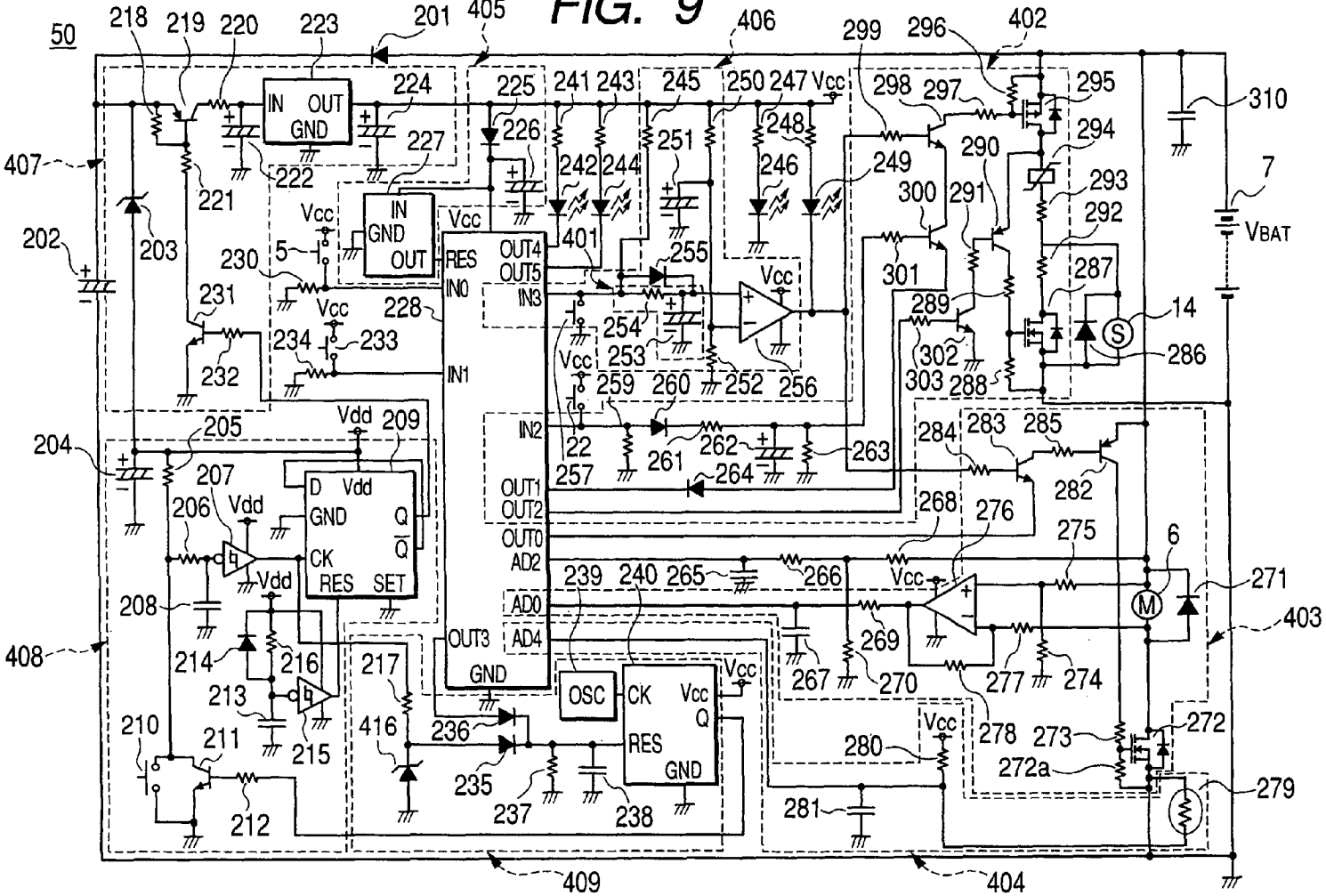
FIG. 9 is a circuit diagram of a controller of the electric driving machine shown in FIG. 1.

In the circuit diagram shown in FIG. 9, the battery voltage $V_{BAT}$ (about 21 V) of the battery pack 7 forms a source for a source voltage Vdd (about 12 V) and the source of a source voltage Vcc (about 5 V). A line for supplying the source voltage Vdd is designated as "Vdd," and a line for supplying the source voltage Vcc is designated as "Vcc."

<Configuration of the Power Control Circuit 408 and the Function of the Power Switch 210>

The power control circuit 408 has the function of activating the fourth switching element 219 when the battery pack 7 is set in the driving machine main body 100, to thus control the entirety of the controller 50 so as to enter an "operable mode." In the case where the driving machine main body 100 is in an operable state, the power control circuit 408 has the function of automatically controlling the controller 50 so as to enter a "low power consumption mode" when the driving machine main body 100 has been left alone for a predetermined period of time or more. The power control circuit 408 also has the function of controlling the controller so as to enter an "operable" mode or a "low power consumption" mode by intentional actuation of the power switch (an operable mode/low power consumption mode changeover switch) 210. The power control circuit 408 has the D-type flip-flop 209, the first Schmidt trigger 207, the second Schmidt trigger 215, the power switch 210, and the switching element 211, such as a transistor, or the like. FIG. 10 shows operation of the power control circuit in the form of an operation table in order to facilitate comprehension of operation of the power control circuit 408 to be described later. In the table, reference symbol "H" designates level "1" to be described later; and "L" designates level "0." Further, an activated state is indicated as "ON," and a deactivated state is indicated as "OFF."

A Q output terminal of the D-type flip-flop 209 is connected to the base resistor 232 of the switching transistor 231, and an inverted Q output terminal of the flip-flop 209 is connected to a D input terminal, and the D-type flip-flop 209 is configured so as to perform toggling operation. As a result, every time a signal of level "1" is input to the clock input terminal CK, the Q output terminal produces a logical output (e.g., level "1") which is an inverse of a logical output having been produced thus far (a logical output produced before one clock input) (e.g. level "0") (see FIG. 10). When the logical output produced by the Q output terminal of the D-type flip-flop 209 is an output of level "1," the switching element 231 is activated, thereby eventually activating the fourth switching element 219. Thus, the fourth switching element 219 acts as a switch which toggles a power supply to the regulator 223 on and off. A commercially-available semiconductor integrated circuit (IC) "MC14013B" can be applied as the D-type flip-flop 209. This D-type flip-flop 209 acts as storage means for storing whether or not the fourth switching element 219 has remained activated thus far; namely, whether or not the fourth switching element 219 has been in an operable mode, or storing whether or not the fourth switching element 219 has remained deactivated; namely, whether or not the fourth switching element 219 has been in a lower-power consumption mode. Storage means other than the D-type flip-flop can also be used as the D-type flip-flop 209.

A first Schmidt trigger inverter 207 is connected to a clock input terminal CK of the D-type flip-flop 209. For instance, a commercially-available semiconductor product MC14584 can be applied to the Schmidt trigger inverter 207. The power switch 210 is coupled to an input side of this Schmidt trigger inverter 207.

The power switch 210 acts as manual switching means and is not limited specifically. By way of example, the power switch 210 is formed from momentary-on switch (or a switch called an normally-open switch). The momentary-on switch means a switch which is in an open state (an OFF state) under normal conditions and which enters an ON state only during a period of time when ON operation (pressing operation) is being performed. The power switch 210 is one which supplies a control signal of level "1" (a kind of clock signal) to the clock input terminal CK of the flip-flop 209 when being activated. Eventually, every time the power switch 210 is activated, a logical output from the output terminal Q of the flip-flop 209 is assumed to be an inverse of the logical output having been produced thus far. Therefore, every time the power switch 210 is activated, the fourth switching element 219 can be controlled so as to be alternately toggled between ON and OFF by way of the output terminal Q of the D-type flip-flop 209. Specifically, the power switch 210 can be caused to act as a toggle switch for toggling the fourth switching element 219 between ON and OFF.

Operation of the power switch 210 will be described in more detail. By activation of the power switch 210, an input level of the Schmidt trigger inverter 207 is inverted from an input of 1 to an input of 0 by virtue of functions of the resistors 205 and 206 and a function of a capacitor 208. Consequently, an output side of the Schmidt trigger 207 (an input terminal CK of the flip-flop 209) is inverted from an output of 0, which has been generated from the output thus far, into an output of 1. Hence, every time the power switch 210 is activated, the logical state of the output terminal Q of the flip-flop 209 is inverted. Simultaneously with the switching element 231 being controlled and toggled between ON and OFF, the fourth switching element 219 is controlled so as to become toggled between ON and OFF.

A reset input circuit consisting of the second Schmidt trigger inverter 215, a resistor 216, a capacitor 213, and a diode 214 is connected to the reset input terminal RES of the D-type flip-flop 209. The resistor 216 and the capacitor 213 constitute a time-constant circuit. When the battery pack 7 is attached to the driving machine main body 100 and electrically connected to the controller 50, the reset input terminal RES of the flip-flop 209 is retained temporarily in a signal input state of level 1 by time-out operation which lasts a predetermined period of time, whereby a Q output terminal of the flip flop 209 is first brought into an output of 0. The fourth switching element 219 is fixed to an OFF state. As a result of the power switch 210 being activated, the Q output terminal of the flip-flop 209 produces an output of 1, thereby activating the fourth switching element 219.

Meanwhile, when the power switch 210 is again activated while the fourth switching element 219 is in an ON state, the output terminal Q of the flip-flop 209 produces an output of 0, thereby deactivating the fourth switching element 219. When the fourth switching element 219 is in an OFF state, the source voltage Vcc of the control circuit including the microcomputer 228 comes to 0 V. The control system supplied with the source voltage Vcc does not consume power. In short, the power switch 210 can make a changeover to the low power consumption mode. In the low power consumption mode, a voltage of about 12 V is supplied as the source voltage Vdd to the first Schmidt trigger inverter 207, the second Schmidt trigger inverter 215, and the D-type flip-flop 209. Since levels of logical outputs produced by the circuits become constant, a current to be consumed comes to a nominal value of the order of microamperes. Therefore, the amount of energy consumed by the battery pack 7 becomes essentially negligible, and a low power consumption mode can be retained. When the power switch 210 is activated in this low power consumption mode, the source voltage Vcc is supplied to the control circuit system of the controller 50, and the controller 50 is restored to an operable state (an operable mode). Further, a switching element 211 formed from a transistor is connected in parallel to the power switch 210. The base of the switching element 211 is connected to a counter control circuit 409, which will be described later, by way of the base resistor 212. As shown in FIG. 10, when having been left in the operable mode for a predetermined period of time (e.g., 15 minutes) or more, the switching element 211 enters an ON state. As in the case of the power switch 210, the switching element 211 has the function of supplying a signal of level 1 to the clock terminal CK of the D-type flip-flop 209, thereby bringing the fourth switching element 219 into an OFF state and automatically making a changeover to the low power consumption mode. Specifically, the power switch 210 operates as manual switching means and serves as a switch capable of arbitrarily switching between the lower power consumption mode and the operable mode. Meanwhile, the switching element 211 acts as electronic switching means capable of switching between the lower power consumption mode and the operable mode in accordance with a command from the microcomputer 228 serving as the control circuit.

<Configuration of the Counter Control Circuit 409>

In order to reduce power requirements of the controller 50, when any of the power switch 210, the push lever switch 22, the trigger switch 5, and the like, has been continually left unactivated for a predetermined period of time; for example, 15 minutes or more, a reset pulse 1 is not input to a reset input terminal RES of the counter 240 (formed from, e.g., a commercially-available semiconductor product 74HC4060); the counter 240 counts up for a predetermined period of time; and the output terminal Q of the counter 240 produces a logical output of 1. AS mentioned previously by reference to FIG. 10, the switching element 211 is activated by this output by way of the base resistor 212, and the fourth switching element 219 is deactivated. Consequently, the supply of the source voltage Vcc to the controller 50 including the microcomputer 228 is stopped. As a result, as in the case where the power switch 210 is activated during operation of the controller 50, the controller is controlled so as to enter the lower power consumption mode (a standby state), where the energy of the battery pack 7 is not consumed essentially. When the power switch 210 is turned on in this low power consumption state, the controller 50 can be restored to the operable state as mentioned previously.

A clock signal is supplied from an oscillation section 239 to the clock input terminal CK of the counter 240. Two signals are input to the reset input terminal RES of the counter 240 by way of an OR diode 235 and an OR diode 236. One signal is an output from the Schmidt trigger inverter 207 which is clamped to a predetermined voltage level by the resistor 217 for regulating a voltage level and a Zener diode 416 and then input to the OR diode 235. The other signal is a signal which is output from an output terminal OUT3 of the microcomputer 228 and input by way of the OR diode 236. The output terminal OUT3 of the microcomputer 228 is configured so as to output a reset pulse signal to the reset input terminal RES of the counter 240 every time the power switch 210, the push lever switch 22, the trigger switch 5, and the single-driving mode/continuous-driving mode changeover switch 233 are activated. The reset signal input by way of the OR diodes 235 and 236 is supplied to the reset input terminal RES by way of a filter circuit for absorbing a spike which is made up of a resistor 237 and a capacitor 238.

<Power-on Reset Circuit 405 of the Microcomputer 228 Including a Backup Power Circuit>

The power-on reset circuit 405 of the microcomputer 228 including a backup power circuit will now be described.

The power-on reset circuit 405 of the microcomputer 228 comprises a reset IC 227 which outputs a reset signal; a high-capacitance capacitor 226 serving as a backup power source for the battery pack 7; and a diode 225. The capacitor 226 is constituted of a high-capacitance capacitor formed from an aluminum electrolytic capacitor, an electric double-layer capacitor, or the like. The diode 225 is formed from a Schottky diode which exhibits a high reverse withstand voltage and a low forward voltage drop (a threshold voltage), or the like. This diode 225 is electrically connected along a direction in which voltage supply path Vcc conducts a supply current.

When the fourth switching element 219 is turned on, the microcomputer 228 illuminates the power display LED 246, and the source voltage Vcc is supplied from the power pack 7 by way of the regulator 223. At this point in time, a power-on reset signal (an output of level 1) from the reset IC 227 which is reset at a source voltage of 2.87 V is input to the reset terminal RES of the microcomputer 228. The microcomputer 228 is thereby set to an initial state and starts control operation in accordance with a predetermined program such as that to be described later.

Figure 11:
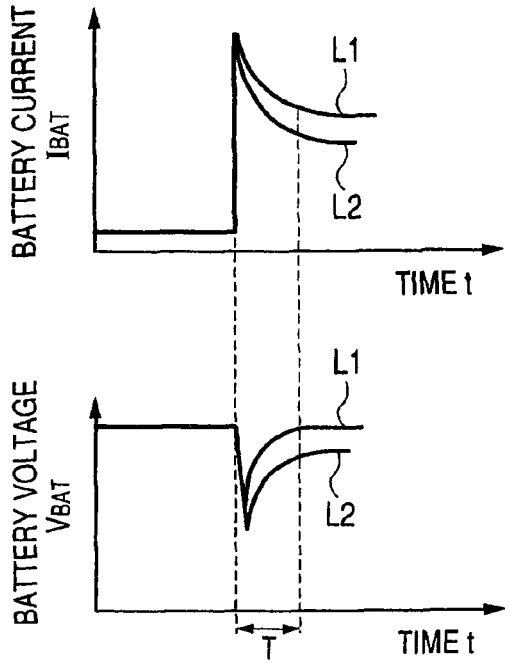
FIG. 11 is a performance characteristic view of a battery pack of the controller shown in FIG. 9.

However, the present inventors have found that operation of the power circuit performed at startup encounters the following problems. Specifically, in order to drive the motor 6 to thus start rotation of the flywheel which poses heavy load on the motor 6, the battery pack 7 flows a heavy startup current (a lock current) to the motor 6. At this time, as shown in FIG. 11, when a battery—which has been discharged when compared with a fully-charged state and has a low amount of remaining electric power (e.g., a battery exhibiting a characteristic L2 shown in FIG. 11)—is used as the battery pack 7, the internal resistance of the battery becomes greater, and the internal voltage drop of the battery pack 7 is increased by the heavy startup current (a battery current). For instance, as indicated by the characteristic L2 in FIG. 11, the battery voltage $V_{BAT}$ becomes smaller. Accordingly, the voltage Vcc output from the regulator 223 also greatly decreases at startup from a predetermined voltage. When a transient state of time T (e.g., 200 milliseconds) passes, it may be the case where unexpected reset operation (erroneous operation) is performed. In order to solve this problem, a high-capacitance capacitor 226 serving as a backup power circuit and a diode 225 exhibiting a low forward voltage are used. By a voltage accumulated by the capacitor 225 and the diode 226, energy required to maintain normal operation of the microcomputer 228 and normal operation of the reset IC 227 can be resupplied for a time of hundreds of milliseconds or more (corresponding to the time T shown in FIG. 11). Hence, unintended reset operation of the microcomputer 228, which would otherwise be caused by a lock current flowing at startup of the motor 6, can be prevented. The transient discharge characteristic shown in FIG. 11 does not arise in a fully-charged state. However, the characteristic poses a problem particularly when discharge of the battery pack 7 has proceeded. For instance, as shown in FIG. 11, when the amount of remaining electric power (accumulated energy) has become smaller as a result of a progress in the discharge of the battery pack 7, the transient discharge characteristic proceeds to the characteristic L1 or the characteristic L2. The capacitance of the capacitor 226 is determined from the time T (FIG. 11) of the transient discharge characteristic which is determined to be a serviceability limit. In the present embodiment, when the amount of electricity remaining in the battery pack being used has approached the serviceability limit (an excessively-discharged state), the battery remaining-power display LED 242 is configured to illuminate as a warning under control of the microcomputer 228. Consequently, the capacitor 226 of the backup power circuit can determine capacitance so that a normal voltage can be resupplied until the warning lamp of the LED 242 is illuminated.

<Configuration of a Motor Drive Circuit and Configuration of a Motor Counter Electromotive Force Detection Circuit 403>

The drive circuit of the motor 6 comprises a motor drive switching element 272 (hereinafter called a "first switching element 272") formed from an N-channel power MOSFET connected in series with the motor 6; and a PNP transistor 282 and an NPN transistor 283 which constitute a drive section of the first switching element. The first switching element 272 is connected in series with the motor 6 in order to subject the power supply to the motor 6 to ON-OFF control. In order to supply high electric power, the battery voltage $V_{BAT}$ of the battery pack 7 is applied directly to this series circuit. Voltage-dividing resistors 272*a* and 273 are connected to a gate of the first switching element 272, thereby constituting negative resistance of the transistor 282. The first switching element 272 is configured so as to be actuated in response to activation of the transistor 282. A collector of the NPN transistor 283 is connected to the base of the transistor 282 by way of a base current limitation resistor 285. The base of the NPN transistor 283 is connected to an output terminal of the operational amplifier 256, which will be described later, by way of a base current limitation resistor 284, and an emitter of the transistor 283 is connected to an output terminal OUT0 of the microcomputer 228. When an output from the operational amplifier 256 is level 1 and an output from the output terminal OUT0 of the microcomputer 228 is level 0, the NPN transistor 283 and the PNP transistor 282 are actuated by the circuit configuration, thereby activating the N-channel MOSFET 272 serving as a motor drive switching element.

The counter electromotive force detection circuit of the motor 6 is equipped with the operational amplifier 276. The operational amplifier 276 constitutes a differential amplifying circuit along with resistors 274, 275, 277, and 278. In order to control the number of rotations of the motor 6, counter electromotive force developing in a coil (not shown) of a rotator of the motor 6 is differentially amplified, and the thus-amplified electromotive force is supplied to the AD conversion terminal AD0 of the microcomputer 228. A resistor 269 and a capacitor 267 constitute a filtering circuit for use with a signal waveform of the counter electromotive force. The diode 271 is for absorbing a flyback voltage of the motor 6.

<Configuration of a Temperature Detection Circuit 404 of the Motor Drive Power FET 272>

Figure 12:
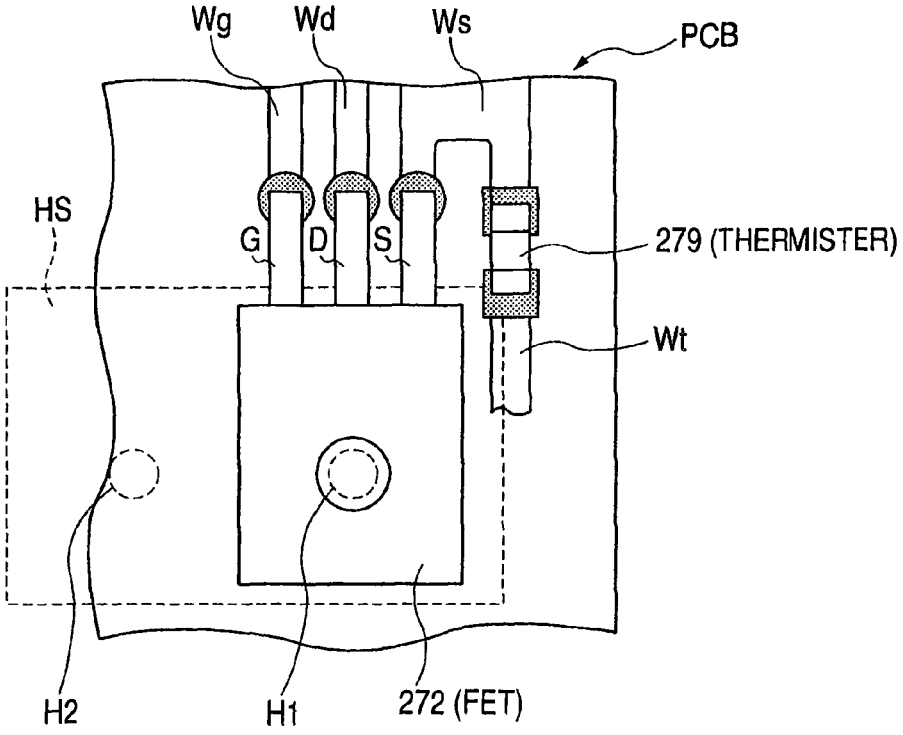
FIG. 12 is a top view of a board on which is mounted a thermister constituting the controller shown in FIG. 9.

The temperature detection circuit 404 of the motor drive power FET (the first switching element) 272 is made up of a thermister 279, a voltage-dividing resistor 280, and a smoothing capacitor 281. The thermister 279 is a temperature measurement element for preventing occurrence of a breakdown in the motor drive power FET (the first switching element) 272, which would otherwise be cause by an excessive temperature rise to 140° C. or higher. As shown in FIG. 12, this thermister element 279 is formed from a chip-type thermister 279 and mounted on a module circuit board PCB along with the power FET 272. Specifically, along with another power FET 295 (not shown in FIG. 12), a source terminal S, a drain terminal D, a gate terminal G of the power FET 272 are soldered respectively to a source wiring line Ws, a drain wiring line Wd, and a gate wiring line Wg of the circuit board PCB. At this time, in order to accurately measure the temperature of the first switching element 272, the chip-type thermister 279 is connected to the source wiring line Ws exposed to a large amount of heat dissipated by the first switching element 272. The other end of the thermister 279 is connected to a constant source voltage Vcc by way of a wiring line Wt and the resistor 280 as well as to an AD conversion terminal AD4 of the microcomputer 228 (see FIG. 9). By this configuration, a potential change in the thermister 279 responsive to the temperature of the source terminal of the first switching element 272 is supplied to the AD conversion terminal AD4 of the microcomputer 228, to thus make the thermister capable of detecting a temperature. Since the first switching element 272 induces a large power loss and dissipates a large amount of heat, a radiator plate (heat sink) Hs formed from a thin metal plate is screwed into a package of the first switching element 272 by way of a machine screw hole H1 as shown in FIG. 12.

<Configuration of a Drive Circuit 402 of the Solenoid 14>

The drive circuit 402 of the solenoid 14 comprises a switching element 295 (hereinafter called a "second switching element 295") formed from a P-channel power MOSFET connected in series with the solenoid 14; an overcurrent protective element 294 which functions to prevent flow of an overcurrent into the second switching element 295 and which is generally known under the designation of "polyswitch"; a switching element 287 (hereinafter called a "third switching element 287") formed from an N-channel power MOSFET connected in parallel with the solenoid 14; and a flyback voltage absorption diode 286 connected in parallel with the solenoid 14. Specifically, the second switching element 295 is connected in series with the solenoid 14 by way of the overcurrent protective element 294 and a current limitation resistor 293, and the third switching element 287 is connected in parallel to the solenoid 14 by way of the current limitation resistor 292.

Voltage-dividing resistors 288 and 289 are connected to a gate of the third switching element 287, thereby constituting load resistance of a pre-PNP transistor 290. The third switching element 287 is configured so as to become activated in response to activation of the transistor 290. A base of the transistor 290 is connected to a collector of another pre-NPN transistor 302 by way of a base current limitation resistor 291. A base of the NPN transistor 302 is connected to an output terminal OUT2 of the microcomputer 228 via a base current limitation resistor 303. By this circuit configuration, the transistors 302 and the 290 are activated by an output of 1 from the output terminal OUT2 of the microcomputer 228, thereby activating the third switching element 287.

Voltage-dividing resistors 296 and 297 are connected to a gate of the second switching element 295, thereby creating a load circuit for the NPN transistor 298 and the NPN transistor 300, which are connected in series with each other. While the transistors 298 and 300 are simultaneously activated, the second switching element 295 can be activated.

As in the case of the base of the NPN transistor 283 of the previously-described motor drive circuit 403, the base of the NPN transistor 298 is connected to an output of the operational amplifier 256 by way of a base current limitation resistor 299. Meanwhile, the base of the NPN transistor 300 is connected to a push lever switch circuit constituted of the push lever switch 22 to be described later, a resistor 259, and other elements, or to the input terminal IN2 of the microcomputer 228. The emitter of the NPN transistor 300 is connected to the output terminal OUT1 of the microcomputer 228. Accordingly, the transistor 298 is activated by an output of 1 from the operational amplifier 256, whereas the transistor 300 is activated when an output from the output terminal OUT1 of the microcomputer 228 assumes a value of 0 and the base potential of the transistor 300 is high. The diode 264 connected to the emitter of the transistor 300 acts as a diode for preventing a reverse flow, which would otherwise be caused when an output from the output terminal OUT1 of the microcomputer 228 assumes a value of 1.

When the push lever switch 22 is turned on, the input terminal IN2 of the microcomputer 228 is brought into a level of 1, and the capacitor 262 is recharged comparatively quickly by way of the diode 260 and the resistor 261, so that a base current becomes ready to flow into the transistor 300 by way of the resistor 301. When the push lever switch 22 remains in an OFF state where the switch is not actuated, the resistor 259 brings the input terminal IN2 of the microcomputer 228 into a level of 0. The resistor 263 is for discharging electric charges in the capacitor 262. Further, an integration circuit constituted of the resistor 261 and the capacitor 262 has the function of supplying the electric charges accumulated in the capacitor 262 as a base current for the transistor 300 even when the push lever switch 22 is deactivated by vibration (chattering) of the switch itself during the course of driving of a fastener, to thus eventually keep the second switching element 295 in an activated state.

<Configuration of the Remaining Fastener Detection Circuit 406>

The remaining fastener detection circuit 406 has the remaining fastener sensor 257, the operational amplifier 256, and a delay circuit 401; and detects that the amount of a fastener, such as nails, loaded in the magazine 2 has become small. The remaining fastener sensor 257 is formed from a microswitch, or the like, provided in association with the nail feeding mechanism 2*a* (see FIG. 2) for feeding joined nails (a fastener) in the magazine 2. When the amount of a fastener aligned in the magazine 2 has become small, an arm 257*a* of the microswitch 257 comes into collision against or contact with the nail feeding mechanism 2*a* in the magazine 2, to thus become activated. As a result of the remaining fastener sensor 257 having been activated, the electric charges charged in a capacitor 253 by way of a resistor 245 and a charge speedup diode 255 when the remaining fastener sensor 257 remains inactive are mildly discharged by way of a resistor 254, and the level of the input terminal IN3 of the microcomputer 228 which has assumed a value of 1 thus far is inverted to a value of 0. The delay circuit 401 is formed from the capacitor 253 and the resistor 254 and has the function of delaying a time lapsing before a signal 0 generated as a result of activation of the switch (the remaining fastener sensor) 257 is input as a signal 0 to a noninverting input terminal (+) of the operational amplifier 256 or the function of attenuating the signal 0. The delay time is determined by a time constant defined by the capacitor 253 and the resistor 254, and is set to a time corresponding to a period of operation during which the driver blade drives a fastener. The function of this delay circuit 401 will be described later.

A voltage determined by dividing the source voltage Vcc by the resistor 250 and the resistor 252 is applied to an inverting input terminal (−) of the operational amplifier 256. As a result of activation of the remaining fastener sensor 257, the noninverting input terminal (+) of the operational amplifier 256 changes from level 1 close to the level of the source voltage Vcc to level 0 at which a value of essentially 0 V is achieved. The output terminal of the operational amplifier 256 is inverted from an output level of 1—which has been achieved thus far—to an output level of 0. Hence, the output terminal of the operational amplifier 256 is inverted to an output of level 0, whereby the LED (a light-emitting diode) 249 constituting a remaining fastener indicator is illuminated. Thus, there is issued a warning that the amount of a fastener remaining in the magazine 2 has become small, and the first switching element 272 and the second switching element 295 are deactivated, to thus cause the driver blade to stop driving a fastener. A capacitor 251 is an integration capacitor for preventing faulty operation such as momentary illumination of the remaining fastener LED 249, which would otherwise be caused as a result of the output terminal of the operational amplifier 256 having temporarily being brought into a level of 0 at the moment in which the battery pack 7 is connected to the controller 50.

<Voltage Detection Circuit of the Battery Pack 7>

The battery voltage $V_{BAT}$ of the battery pack 7 is divided by resistors 268 and 270, and is input to the AD conversion terminal AD 2 of the microcomputer 228 by way of an integration circuit consisting of a resistor 266 and a capacitor 265. The microcomputer 228 detects the voltage of the battery pack 7, and monitors the amount of energy remaining in the battery pack 7 by the battery remaining-power display LED 242.

<Display Circuit>

The LED 246 is a power source indicator connected in shunt with the regulator 223 by way of a current limitation resistor 247 and is illuminated when the regulator 223 remains in a normally-operating state (an operable state).

The LED 242 is a battery remaining-power indicator connected between the output terminal OUT4 of the microcomputer 228 and the output voltage Vcc of the regulator 223 by way of the current limitation resistor 241. When the amount of electric power remaining in the battery pack 7 after electrical discharge has become small, the LED 242 is illuminated. For instance, when the amount of electric power remaining in the battery pack 7 has become smaller than 18 V, the LED 242 is illuminated.

Further, the LED 244 is a mode indicator connected between the output terminal OUT5 of the microcomputer 228 and the output voltage Vcc of the regulator 223 by way of the current limitation resistor 243 and, especially, acts as a continuous-driving mode indicator when the controller 50 is in a continuous-driving mode.

<Configuration of Other Circuits>

When the trigger switch 5 is switched to the ON position, a signal of level 1 is input to the input terminal IN0 of the microcomputer 228. The resistor 230 connected in series with the trigger switch 5 is provided for inputting a signal of level 0 to the input terminal IN0 of the microcomputer 228 when the trigger switch 5 remains in the OFF position.

Likewise the power switch 210, the switch 233 is formed from a momentary-on switch (or a normally-open switch) and acts as a single-driving mode/continuous-driving mode changeover switch. When the single-driving mode/continuous-driving mode changeover switch 233 is toggled ON, there is made a changeover to a continuous-driving mode when the current mode is a single-driving mode. Conversely, when the current mode is a continuous-driving mode, a changeover is made to the single-driving mode. Every time the switch 233 is toggled to ON, a signal of level 1 is input to the input terminal IN1 of the microcomputer 228. The resistor 234 connected in series with the single-driving mode/continuous-driving mode changeover switch 233 is provided for inputting a signal of level 0 to the input terminal IN1 of the microcomputer 228 when the single-driving mode/continuous-driving mode changeover switch 233 remains in the OFF position.

[Basic Operation of the Electric Driving Machine 100 for Driving a Fastener]

The basic operation of the electric driving machine 100 for driving a fastener will now be described from a mechanical viewpoint. When an operator has pulled the trigger switch 5 and also pushes the push lever switch 22 against a member to be worked (a workpiece), the first switching element 272 is activated by control operation of the controller 50, so that the motor 6 rotates while taking the battery pack 7 as the power source (see FIG. 1). Thus, the rotational drive force of the motor 6 is transmitted to the flywheel 9 by way of the motor gear 8 mechanically connected to the motor 6, whereby the coil spring 13 attached to the rotary drive shaft 10 is rotated (see FIG. 4). In this state, the rotational speed of the flywheel 9 is increased to a predetermined value with an increase in the number of rotations of the motor 6 and lapse of a time. The greater the rotational speed of the flywheel 9 driven by the motor 6 becomes, the greater kinetic energy is accumulated. At this time, as shown in FIGS. 4 and 6, since the inner diameter of the coil spring 13 is greater than the inner diameter of the driven rotary shaft 12, the rotational force of the coil spring 13 does not induce rotation of the driven rotary shaft 12. Moreover, a problem of friction, which would otherwise arise when sliding contact has taken place between the coil spring 13 and the driven rotary shaft 12, does not arise.

When the controller 50 energizes the solenoid 14 after a predetermined period of time has elapsed since the flywheel 9 was rotated, the solenoid drive section 15 and the impelling member 16 move toward the flywheel 9 as shown in FIGS. 7 and 8. Accordingly, the balls 19 are pushed toward the outer circumference from the holes 18 of the driven rotary shaft 12 by the tapered groove 16*a* of the impelling member 16. The balls 19 having projected from the holes 18 toward the outer circumference are engaged with the groove section 25*a* of the clutch ring 25, and the clutch ring 25 is mechanically connected to the driven rotary shaft 12 by way of the balls 19. Consequently, the other end section 13*b* of the coil spring 13 is inserted into the hole 25*b* of the clutch ring 25. Hence, the right-side spring section 13*d* of the coil spring 13 is wound around the driven rotary shaft 12 in conjunction with rotation of the clutch ring 25. Consequently, sufficient frictional force develops between the coil spring 13 and the outer circumferential surface of the driven rotary shaft 12 because of the winding force induced by the rotational force of the rotary drive shaft 10, so that the driven rotary shaft 12 can acquire sufficient rotational speed within a period of tens of milliseconds. Moreover, when the driven rotational shaft 12 rotates, the pinion 11 also rotates synchronously. Therefore, the actuator feeding mechanism 3*c*—by which the pinion 11 meshes with the rack 3*b* of the actuator 3—moves in a direction where the driver blade 3*a* approaches closely to the fastener charged in the magazine 2, and driving is completed when the driver blade 3*a* has finished colliding with (driving) the fastener.

Driving of the solenoid 14 is also completed at the time of completion of driving operation, and the solenoid drive section 15 and the impelling member 16 are returned to the initial position by restoration force of the solenoid return spring 17. When the impelling member 16 has returned to the initial position, the force for pushing the balls 19 dissipates, and hence the frictional force developing between the balls 19 and the clutch ring 25 decreases to a negligible level, and the inner diameter of the coil spring 13 expands until a natural state is achieved. At this time, transmission of power from the rotational drive shaft 10 to the driven rotary shaft 12 is interrupted, and therefore the driver blade 3 and the pinion 11 and the actuator 3 of the actuator feeding mechanism 3*c* are brought into their initial states by the actuator return spring 23.

[Control Operation of the Controller 50]

Operation of the controller 50, which is a characteristic of the present embodiment, will now be described in detail by reference to control flowcharts described in FIGS. 13, 14, and 15.

Operation of the power control circuit 408 performed when the battery pack 7 is attached to and electrically connected to the controller 50 (the driving machine main body 100) is as shown in FIG. 10. As described above by reference to FIG. 10, the switching element 219 of the power circuit 407 enters an OFF state immediately after attachment of the battery pack 7. When the power switch 210 is activated subsequently, an output of level 0 having appeared at the output terminal Q of the flip-flop 209 thus far is inverted to an output of level 1 as shown in FIG. 10, thereby activating the fourth switching element 219. Consequently, the regulator 223 outputs 5 V, to thus recharge the capacitor 226 to about 5 V. When a constant voltage of 5 V is applied to the input terminal IN of the reset IC 227, a power-on reset signal (a signal of level 1) is input from the output terminal OUT of the reset IC 227 to the reset input terminal RES of the microcomputer 228. The microcomputer 228 starts operation in accordance with the control flowcharts of driving operation described in FIGS. 13, 14, and 15.

First, in step S501, the microcomputer 228 outputs a signal of level 1 to the output terminal OUT2 so as to bring the third switching element 287 into an ON state and to set a "single-driving mode." Further, a signal of such a level as to bring the continuous-driving mode display LED 244 into an extinguished state is output to the output terminal OUT5.

Next, in step 502, a check is made as to whether or not the trigger switch 5 and the push lever switch 22 are in an OFF state. When both these switches are in the OFF state, an initial state (step 566) is determined to have been achieved, and the following operation is commenced.

<Processing for Displaying the Amount of Electrical Power Remaining in the Battery Pack 7>

In steps 503 through 505, there is performed remaining power display processing for ascertaining whether the battery pack 7 is recharged or the amount of electrical discharge is large. In the case where the microcomputer 228 has read the battery voltage $V_{BAT}$ of the AD conversion terminal AD2 and where the motor 6 and the solenoid 14 remain inoperative, when the voltage of the battery pack 7—in which; for instance, six lithium-ion secondary cells are connected in series, and which exhibits a nominal voltage of 21.6 V—has become less than; e.g., 18 V, the microcomputer 228 brings the LED 242 from the extinguished state into the illuminated state. Since the output of battery voltage from the battery pack 7 is in the course of recovery within one second after driving of a fastener, the microcomputer 228 does not perform these processing operations or subjecting a read detection voltage of the AD conversion terminal AD2 to moving-averaging operation, to thus compute the true amount of electric energy remaining in the battery pack 7 and display the amount of remaining electric power.

<Processing for Detecting the Temperature of the First Switching Element 272>

In step 506, the microcomputer 228 checks, from the input voltage of the AD conversion terminal AD4, whether or not the temperature of the first switching element 272 is equal or lower than a predetermined temperature; for example, 140° C. When the temperature has exceeded 140° C., processing proceeds to step 507, where a dynamic stop state is achieved and where the LEDs 242 and 244 are continually blinked. Thus, fastener driving operation subsequent to step 508 is stopped. At this time, the first switching element 272 is not activated by the microcomputer 228.

<Processing for Toggling Between the Single-Driving Mode and the Continuous-Driving Mode>

Steps 508 to 511 are for performing processing for toggling between a single-driving mode and a continuous-driving mode. In these steps, when the single-driving mode/continuous-driving mode changeover switch 233 is activated, the microcomputer 228 is switched from the initially-set "single-driving mode" to the "continuous-driving mode," and the continuous-driving mode display LED 244 is illuminated to set the "continuous-driving mode." When the single-driving mode/continuous-driving mode changeover switch 233 is activated while the microcomputer 228 is in the state of setting the "continuous-driving mode," the microcomputer 228 is configured so as to again set the "single-driving mode." The single-driving mode/continuous-driving mode changeover switch 233 acts as a so-called toggle switch, and toggles between the single-driving mode and the continuous-driving mode every time the switch 233 is activated.

<Processing in Single-Driving Mode>

When a single-driving mode is determined in step 512, processing proceeds to steps 513 to 515 according to the present invention, and processing for single-driving mode is carried out.

Specifically, when in step 513 the trigger switch 5 is first activated, processing proceeds to step 514. The microcomputer 228 outputs a signal of level 0 from the output terminal OUT0, to thus initiate rotation of the motor 6. Concurrently with initiation of rotation, in step 515 the two timers T1 and T2 (not shown) in the microcomputer 228 start counting a time. In this case, the timer T1 has the function of measuring elapsed predetermined time (a first acceleration time) A required by the motor 6 to reach a predetermined constant speed C (rpm) (C is set to; e.g., 21,000 rpm) or a speed close to the constant speed; for instance, a period of 350 milliseconds (hereinafter the unit of time is often called milliseconds or abbreviated as "ms"). The timer T2 has the function of measuring elapsed time assigned to a determination as to whether or not the following processing is left. After the trigger switch 5 has first been activated, the timer T1 finishes measuring operation after elapse of a predetermined time A (350 milliseconds), and processing proceeds to step 518, where control of a PWM speed is commenced such that the motor 6 achieves a predetermined constant speed C (e.g., 21,000 rpm). Control of the constant speed of the motor 6 will be described later.

Figure 16:
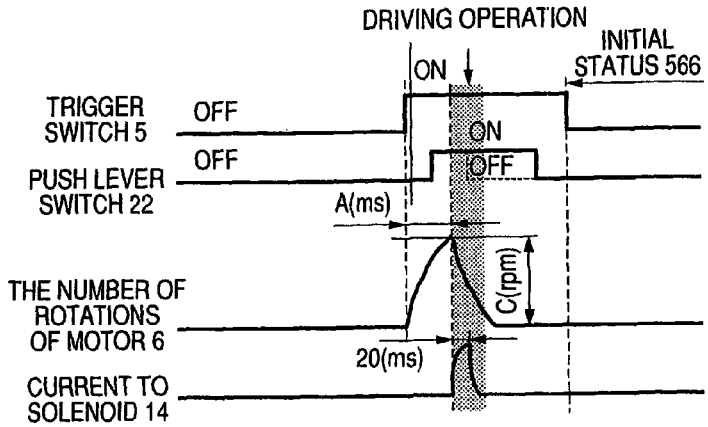
FIG. 16 is a timing chart showing a first operation pattern of the electric driving machine shown in FIG. 1.

As indicated by the operation timing chart shown in FIG. 16, the operator pushes the extremity 22 of the driving machine main body 100 (see FIG. 1) against an unillustrated member to be worked (a workpiece) after first actuation of the trigger switch 5 and before elapse of the predetermined time A (350 milliseconds), the push lever switch 22 (see FIG. 9) is turned on. When the push lever switch 22 has been turned on, the push lever switch 22 is determined to be active in step 522, and control processing pertaining to steps 523 to 530 is performed. Specifically, after the predetermined time A (milliseconds) has elapsed since the trigger switch 5 was actuated, in step 523 a signal of level 1 is output from the output terminal OUT0 of the microcomputer 228, thereby deactivating the transistor 283. Thus, the motor 6 is deactivated. In step 524, a signal of level 0 is output from the output terminal OUT2 of the microcomputer 228, thereby deactivating the third switching element 287 serving as a faulty operation prevention switch. Thus, preparation for flow of an excitation current to the solenoid 14; namely, preparation for activation of the solenoid 14, is completed. In step 525, elapse of 10 milliseconds is awaited, and a signal of level 0 is output from the output terminal OUT1 of the microcomputer 228 in step 526, thereby activating the second switching element 295 and the solenoid 14. Subsequently, in step 527 the solenoid 14 is held in an ON state for 20 milliseconds. In step 528, a signal of level 1 is output from the output terminal OUT1 of the microcomputer 228, to thus deactivate the second switching element 295 and the solenoid 14. By actuation of the solenoid 14 constituting the clutch means (engagement/disengagement means) performed in steps 526 and 528, the rotational drive force of the flywheel 9 is transmitted as rectilinear drive force to the actuator 3 by way of the coil spring 13 constituting the clutch means. As a result, the driver blade 3*a* drives the fastener (a nail) charged in the nose 1*c* (see FIG. 2), whereupon the fastener is driven into the workpiece. Subsequently, in step 529, the solenoid 14 is held in an OFF state for 10 milliseconds in order to prevent occurrence of a faulty operation. In step 530, a signal of level 1 is output from the output terminal OUT2 of the microcomputer 228, to thus activate the third switching element 287 serving as a faulty operation prevention switch and holding the solenoid 14 in the OFF state. In step S532, when the trigger switch 5 and the push lever switch 22 are determined to be in the OFF state, preparation of the next fastener driving operation is achieved by way of the initial state 566.

<Patterns of an Operation Timing Chart for a Single-Driving Mode>

Driving patterns in a single-driving mode of the present embodiment will now be described.

(First Pattern)

FIG. 16 shows an example operation timing chart of the electric driving machine 100 conforming to the above-mentioned control flowchart. In FIG. 16, activation (the ON state) or deactivation (the OFF state) of the push lever switch 22 is indicated by a broken line. Even when the push lever switch 22 has been deactivated in the middle of driving of a fastener because of a recoil resulting from the electric driving machine 100 driving a fastener, the fastener driving operation can be completed by the electric charges stored in the capacitor 262.

(Second Pattern)

Figure 17:
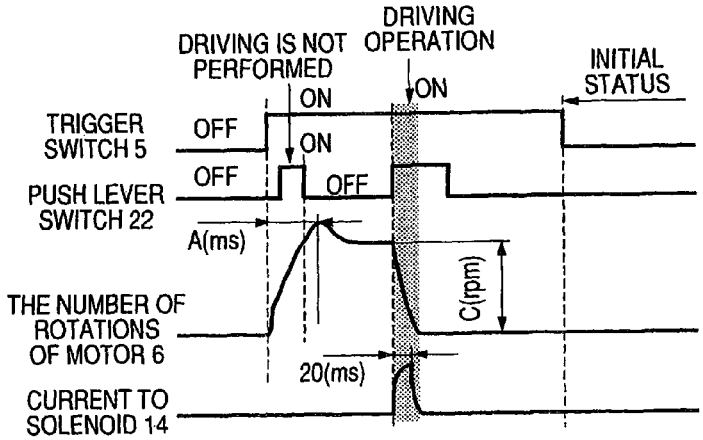
FIG. 17 is a timing chart showing a second operation pattern of the electric driving machine shown in FIG. 1.

As indicated by the control flowchart shown in FIG. 13 and the operation timing chart shown in FIG. 17, even when the push lever switch 22 is activated or deactivated after actuation of the trigger switch 5 and before elapse of a predetermined time A (ms), fastener driving operation is not performed. So long as the push lever switch 22 is reactivated, after elapse of a predetermined time A (350 ms), at a stage where the motor 6 is controlled to a constant speed, fastener driving operation is performed.

(Third Pattern)

As indicated by the operation timing chart shown in FIG. 18, in a case where the timer T1 has finished measuring elapsed predetermined time A and where a predetermined constant speed C (e.g., 21,000 rpm) has been reached as a result of initiation of constant-speed control of the motor 6 pertaining to step 518 to be described later, when the push lever switch 22 is activated, there is performed fastener driving operation as in the previously-described case before the timer T2 finishes measuring elapsed predetermined time (an unattended limit time); e.g., four seconds (hereinafter the unit of time "second" is sometimes described as "s").

(Fourth Pattern)

Figure 19:
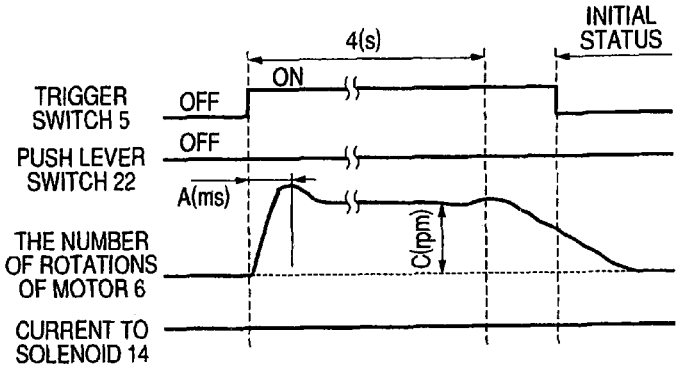
FIG. 19 is a timing chart showing a fourth operation pattern of the electric driving machine shown in FIG. 1.

As indicated by an operation timing chart shown in FIG. 19, when the push lever switch 22 is not activated even when the timer T2 has completed measuring elapsed predetermined unattended limit time; for example, four seconds, since activation of the trigger switch 5, the timer T2 completes measuring elapsed time by processing pertaining to steps 520 and 531, thereby deactivating the motor 6. Moreover, when the trigger switch 5 is deactivated in midstream after having been activated, processing proceeds to step 531 by processing pertaining to step 516 or 521, where the motor 6 is deactivated.

(Fifth Pattern)

Figure 21:
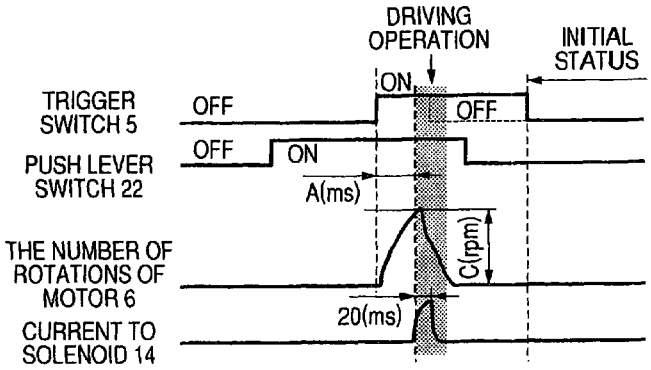
FIG. 21 is a timing chart showing a fifth operation pattern of the electric driving machine shown in FIG. 1.

As indicated by an operation timing chart shown in FIG. 21, when the push lever switch 22 is first activated and the trigger switch 5 is activated later, processing proceeds from step 513 to step 514. In step 514, the motor 6 starts rotating. In step 515, the timer T1 and the timer T2 start operation. Further, in step 517, the timer T1 finishes measuring operation after elapse of the predetermined time A (350 milliseconds), and in step 522 the push lever switch 22 is determined to be activated, and processing immediately proceeds to step 523. Fastener driving operation is performed in accordance with steps subsequent to step 523. Steps subsequent to step 523 are the same as those described previously. In final step 532, preparation of the next operation for driving fastening staple is made by way of an initial state 566 where both the trigger switch 5 and the push lever switch 22 are deactivated. As is evident from the control flowchart shown in FIG. 13 and indicated by the broken line showing activation (the ON state)/deactivation (the OFF state) of the trigger switch 5, fastener driving operation is normally completed even when the trigger switch 5 becomes deactivated in the middle of fastener driving operation.

(Sixth Pattern)

Figure 22:
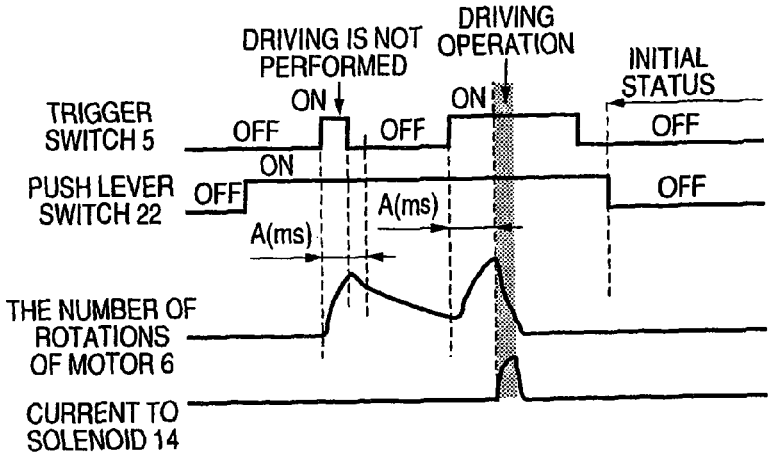
FIG. 22 is a timing chart showing a sixth operation pattern of the electric driving machine shown in FIG. 1.

As is indicated by an operation timing chart shown in FIG. 22, even when the trigger switch 5 is activated and deactivated within elapse of the predetermined time A (350 milliseconds) after activation of the push lever switch 22, fastener driving operation is not performed. By activation of the trigger switch 5 involving elapse of the predetermined time A (350 milliseconds), fastener driving operation is performed.

<Speed Control of the Motor 6 and Detection of Counter Electromotive Force>

(Speed Control)

Figure 18:
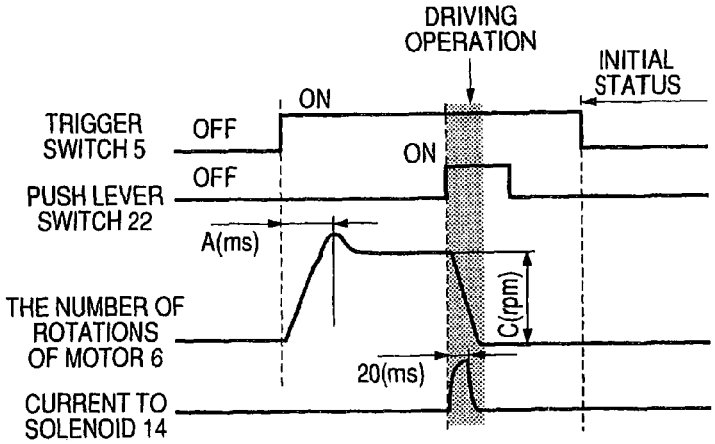
FIG. 18 is a timing chart showing a third operation pattern of the electric driving machine shown in FIG. 1.
Figure 20:
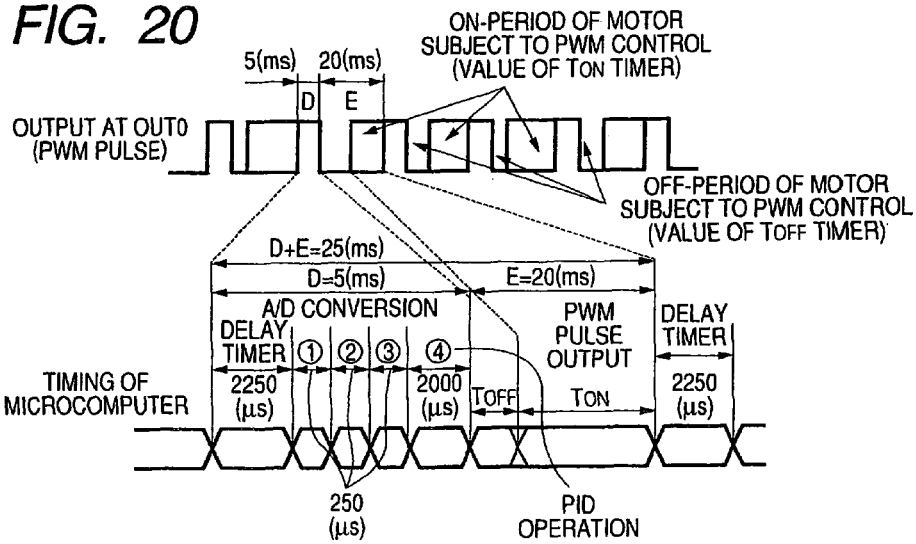
FIG. 20 is a timing chart for describing PWM speed control operation of the electric driving machine shown in FIG. 1.

As indicated by the pattern of the timing chart shown in FIG. 18, the timer T1 finishes measuring operation after lapse of the predetermined time A (350 milliseconds) after the trigger switch 5 was first activated, and processing proceeds to step 518, where control of a PWM speed is started such that the motor 6 comes to a predetermined constant speed C (rpm); e.g., 21,000 rpm. The PWM speed is controlled in accordance with the timing of a PWM pulse output from the output terminal OUT0 of the microcomputer 228, such as that shown in FIG. 20. The PWM pulse shown in FIG. 20 includes, as a timing of one period, a first predetermined period D for toggling the power supply from the battery pack 7 to the motor 6 off and a second predetermined period E for controlling the power supply to the motor 6 by toggling the power supply from the battery pack 7 to the motor 6 on or off. Specifically, in the first predetermined period D (e.g., 5 ms), a signal of level 1 is output to the output terminal OUT0 of the microcomputer 228, to thus deactivate the first switching element 272. In this first predetermined period D, the counter electromotive force of the motor 6 (proportional to the number of rotations of the motor) is detected by the previously-described motor counter electromotive force detection circuit 403, and a result of detection is compared with the counter electromotive force of the motor—which corresponds to the number of rotations achieved at constant speed and serves as a target—by PID operation. In a second predetermined period E (e.g., 20 ms) subsequent to the first predetermined period D, a power-feeding time ratio of a period of time during which power is not supplied to the motor 6 to a period of time during which power is supplied to the motor 6 within the second predetermined period E; namely, a ratio of a motor-deactivated period $T_{OFF}$ to a motor-activated period $T_{ON}$ in FIG. 20, is determined from the result of comparison performed through the PID operation. The PWM pulse used for maintaining the number of rotations of the motor 6 at the constant-speed rpm C (rpm) is output as a signal of level 1 or level 0 to the output terminal OUT0 of the microcomputer 228. The motor 6 is subjected to PWM control by activating or deactivating the first switching element 272. FIG. 20 also shows control timing of the microcomputer 228 employed during this speed control operation. Procedures for controlling the motor to a constant speed will be described in detail hereunder.

Figure 15:
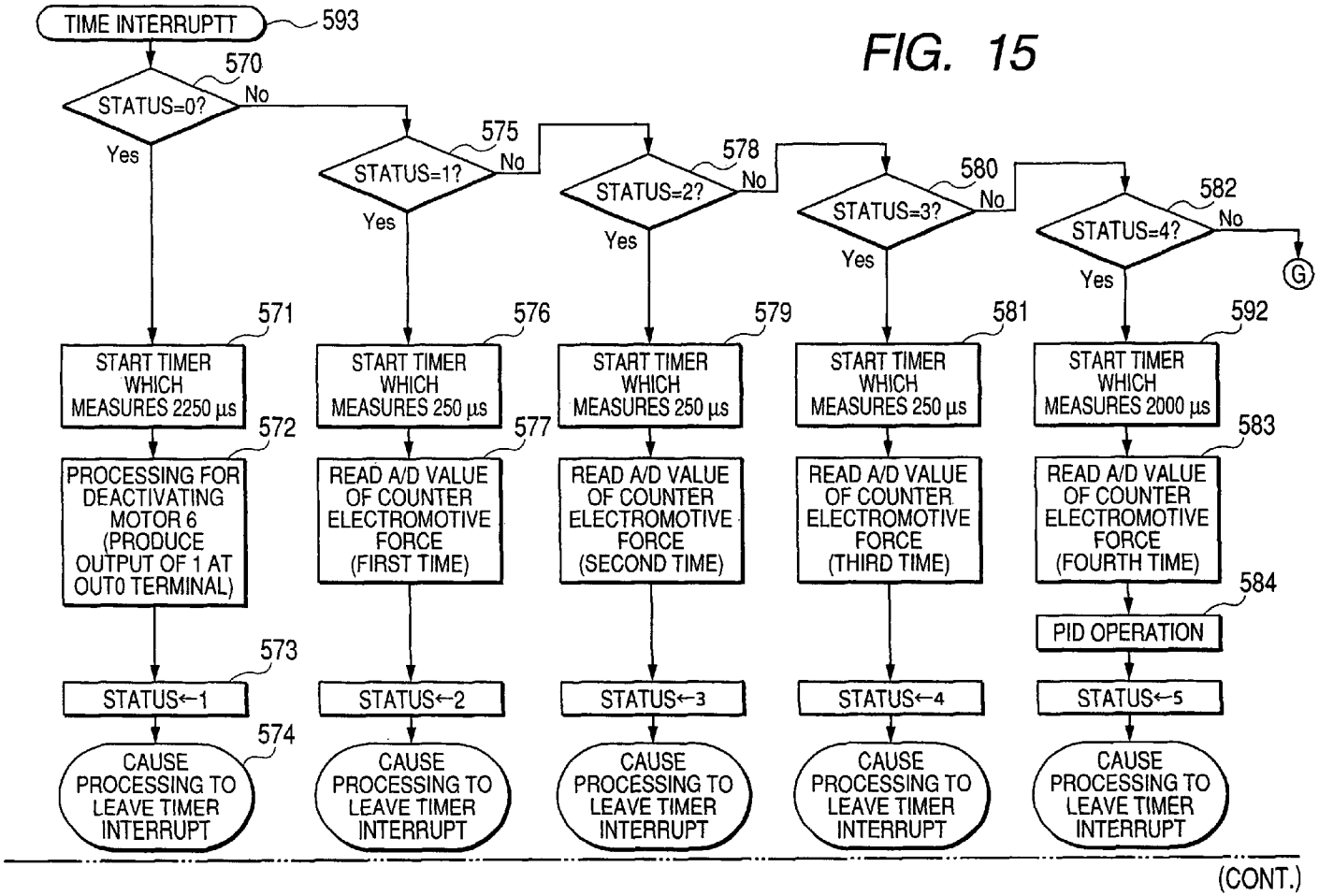
FIG. 15 is a third flowchart showing control procedures continuous from the first and second flowcharts shown in FIGS. 13 and 14.

The motor 6 is controlled to a constant speed by use of the PWM pulse in step 518 as indicated by the processing flowchart shown in FIG. 15. Namely, there is initiated processing pertaining to step 593 where the microcomputer 228 causes a timer interrupt. In step 570, a first processing status (STATUS=0) is determined. In step 571, there is started a timer which measures a period of time where counter electromotive force of the motor 6 can be accurately detected during a period of deactivation of the motor 6 within a predetermined first period D (e.g., five milliseconds); for example, 2250 microseconds (hereinafter the unit of microsecond is often described as "μs"). In step 572, the motor 6 is deactivated. In step 573, STATUS is set to one. Thus, in step 574, processing temporarily leaves the step of timer interrupt. A period of 2250 μs is set as a period of time during which the counter electromotive force of the motor 6 can be detected correctly without being affected by a flyback current induced by the inductance of a coil or other currents. Subsequently, after elapse of 2250 μs, timer-interrupt processing pertaining to step 593 is initiated again. Processing pertaining to step 576 and subsequent steps is performed by way of ascertainment of STATUS=1 in step 575. Processing is arranged such that timer-interrupt processing pertaining to step 593 is next initiated after 250 μs. Counter electromotive force of the motor 6 is read from the AD conversion terminal AD0 of the microcomputer 228. Likewise, every time timer-interrupt processing pertaining to step 593 is initiated, processing pertaining to steps 578, 580, 582, 585, and 588; processing pertaining to steps 579, 581, 592, 586, and 589 subsequent to respective STATUSES of steps 578, 580, 582, 585, and 588; and processing subsequent to steps 579, 581, 592, 586, and 589 are performed.

Specifically, as indicated by the timing chart shown in FIG. 20, the counter electromotive force (counter electromotive voltage) of the motor 6 is read, every 250 μs and four times, from the AD conversion terminal AD0 of the microcomputer 228. In the flow of processing pertaining to step 582, a fourth AD-converted value is read in step 583. Subsequently, in step 584, four read AD-converted values are averaged. The thus-determined average value and the counter electromotive force of the motor 6 serving as a predetermined target are subjected to PID computing operation. In steps 586 and 589, there are computed the OFF time (a $T_{OFF}$ time) of the motor 6 and the ON time (a $T_{ON}$ time) of the motor 6 in the predetermined second period E during which the motor 6 is subjected to PWM control. Further, the $T_{OFF}$ timer and the $T_{ON}$ timer are started, respectively. As shown in FIG. 20, the sum of a value determined by the $T_{OFF}$ timer that sets an OFF time of the motor 6 and a value determined by the $T_{ON}$ timer that sets an ON time of the motor 6 serves as a predetermined time E (20 ms) of the PWM pulse shown in FIG. 20.

As is evident from the above descriptions, in FIG. 20, the PWM speed control of the motor 6 acts as constant speed control. In this control, 5 (ms) is allocated to a first predetermined time (an OFF allocation time) D required for AD conversion and PID operation, which are intended to detect counter electromotive force; 20 (ms) is allocated to a second predetermined time (an ON allocation time) E required to activate/deactivate the motor 6; and a total of 25 (ms) is taken as one period. The delay timer creates a delay of 2250 (μs) immediately after deactivation of the motor 6 before appearance of counter electromotive force. Counter electromotive force (a counter electromotive voltage) is measured four times every 250 (μs) from the first measurement to the fourth measurement. In a period of 2000 (μs) subsequent to the fourth measurement of counter electromotive force, PID operation is performed. In accordance with the $T_{OFF}$ period and the $T_{ON}$ period of the PWM pulse output determined through PID operation, the motor 6 is activated and deactivated by the illustrated $T_{OFF}$ timer value and the $T_{ON}$ timer value. The motor 6 is controlled to constant speed by iteration of a series of operations.

As described as a time (a first acceleration time) A (ms) in the timing chart shown in FIG. 17, the period of predetermined time A (ms) from when the motor 6 is started until when above-described constant speed control is commenced corresponds to a phase in which the number of rotations of the motor 6 is increasing toward a set value of a predetermined constant-speed rpm C (rpm). Accordingly, in order to immediately increase the number of rotations of the motor 6, holding the first switching element 272 in the ON position at all times for the period of time A, to thus cause the motor 6 to operate continually, is desirable. After elapse of the predetermined time A (ms), it is preferable to iterate on-off control of the first switching element 272 as mentioned above and to perform speed control while measuring the number of rotations of the motor 6 from speed electromotive force acquired at the time of deactivation of the motor.

(Detection of Counter Electromotive Force of the Motor 6)

As mentioned above, the circuit for detecting the counter electromotive force of the motor 6 comprises the operational amplifier 276, and the resistors 274, 275, 277, and 278 which constitute a differential amplifying circuit along with the operational amplifier 276. The counter electromotive force developing in a coil (not shown) of a rotor of the motor 6 is supplied to the AD conversion terminal AD0 of the microcomputer 228 by way of a filter circuit consisting of the resistor 269 and the capacitor 267. The motor 6 is controlled to a constant speed such that the kinetic energy of the flywheel 9 accumulated by rotational driving of the motor 6 turns into energy which is used for driving a fastener. The counter electromotive force of the motor 6 achieved at this time also reaches a predetermined voltage. Accordingly, this counter electromotive force is compared with a preset voltage through arithmetic operation, so that the rotational drive force of the motor 6 optimum for driving a fastener can be maintained. To be more specific, a circuit equivalent to the DC motor 6 comprises coil inductance, the resistance of a coil, a voltage drop occurring in a brush, and speed electromotive force determined by the magnetic field and the rotational speed of the motor. Among these factors, the inductance of the core, the resistance of a coil, and the voltage drop in a brush are changed by the electric current of the motor. However, during a period in which the first switching element 272 remains in the OFF state, the speed electromotive force of the motor 6 can be considered to arise as a motor voltage. The speed electromotive force is proportional to the number of rotations of the motor 6. Accordingly, the number of rotations of the motor; namely, the number of rotations of the mechanically-coupled flywheel 9, can be ascertained by the circuit for detecting counter electromotive force of the motor 6. The microcomputer 228 compares the thus-detected counter electromotive voltage with the predetermined voltage, to thus perform so-called PID operation. As a result, the motor 6 can be maintained at the predetermined constant rpm C (rpm). This obviates the necessity for attachment of a rotational sensor to the flywheel, and a reduction in the cost and size of a product can be attained.

<Prevention of Faulty Operation of the Solenoid Drive Circuit 402>

When an excitation current falsely flows into the solenoid 14 during rotation of the motor 6, fastener driving operation is performed against the operator's will. The microcomputer 228 outputs a signal of level 1 from the output terminal OUT2 except the period of fastener driving operation, thereby activating the third switching element 287. Thus, faulty driving operation can be prevented. Even when the second switching element 295 has become shorted for any reason and when an overcurrent has flowed into the overcurrent limitation polyswitch 294 and the current limitation resistor 293, the electric currents are diverted to the active third switching element 287 and hardly flow into the solenoid 14, so long as the third switching element 287 remains activated. Hence, faulty fastener driving operation can be prevented. Meanwhile, when a signal of level 0 is output from the output terminal OUT1 of the microcomputer 228 for any reason while the second switching element 295 remains in normal condition, the push lever switch 22 is in an off state. Hence, a base current does not flow into the pre-transistor 300, and the second switching element 295 is not activated. Accordingly, faulty fastener driving operation can be prevented. Prevention of faulty operation enables enhancement of the accuracy of finishing and working efficiency.

<Processing Flowchart and Operation Timing Chart for Continuous-Driving Mode>

In a case where a result of determination rendered in step 512 shown in FIG. 13 shows a continuous-driving mode, when the trigger switch 5 is activated in step 540 as shown in the processing flowchart for the continuous-driving mode shown in FIG. 14, processing proceeds from step 540 to step 541 and subsequent steps. In step 541, a signal of level 0 is output from the output terminal OUT0 of the microcomputer 228, to thus start rotation of the motor 6. In step 542, the timer T1 and the timer T2 are started. Subsequently, the push lever switch 22 is activated, whereby processing proceeds from step 548 to step 549 and subsequent steps after in step 544 the timer T1 has measured elapse of the predetermined period of time A (350 milliseconds). Pursuant to processing analogous to processing pertaining to steps 523 to 530 in the single-driving mode, the motor 6 is stopped, and the solenoid 14 is activated, to thus drive a fastener.

When the push lever switch 22 remains deactivated even after elapse of the predetermined period of time A (350 milliseconds) in step 544, timer-interrupt processing pertaining to step 593 (see FIG. 15) subsequent to step 545 is started, and constant-speed control of the motor 6 is performed according to the above-mentioned sequence. Sequence from step 549 to step 550 analogous to sequence from step 523 to step 530 in a single-driving mode is executed one after another, so long as the push lever switch 22 is activated before elapse of four seconds measured by the timer T2 after activation of the trigger switch 5. The motor 6 is stopped, and the solenoid 14 is actuated, thereby driving a fastener. In contrast, when the push lever switch 22 is not activated before elapse of the predetermined period of time (four seconds) measured by the timer T2 after activation of the trigger switch 5, the rotation of the motor 6 is stopped in step 531 in accordance with a result of determination rendered in step 546.

When the trigger switch 5 still remains in the ON state after previous fastener driving operation, processing proceeds from step 551 to step 552 and step 553. In step 555, after operation for driving a fastener, the timer T3 completes measurement of elapsed predetermined time (a second acceleration time) B (e.g., 200 milliseconds) which is shorter than the predetermined time A. In step 555, in the range of predetermined time B (200 milliseconds) which the timer T3 has not yet finished measuring, the battery voltage $V_{BAT}$ of the battery pack 7 is fully supplied to the motor 6, to thus generate rotational drive force quickly. After elapse of the predetermined time B (200 milliseconds), constant-speed control is performed by PWM pulse control.

After the previous fastener driving operation, the push lever switch 22 is temporarily toggled to the OFF position. Subsequently, when the push lever switch 22 is again turned on, processing passes through, processing pertaining to a sequence between steps 564 and 565 analogous to the sequence from step 523 to 530 is executed one after another by bypassing steps 559 to 563 after elapse of the predetermined time B (200 milliseconds). Fastener driving operation is executed by stopping the motor 6 and driving the solenoid 14.

At this time, when the push lever switch 22 temporarily remains deactivated after the previous fastener driving operation, the motor 6 is still in rotation even after the previous fastener driving operation. Hence, in relation to the time during which the number of rotations required to drive a fastener is reached, a timer interrupt pertaining to step 556 (step 593 shown in FIG. 15) is allowed after elapse of the required time B (200 milliseconds) that is shorter than the time A (350 milliseconds) required to put the motor 6 in motion from the stationary state. The motor 6 is controlled to constant speed by PWM pulse control. When the push lever switch 22 is activated in this state, processing pertaining to a sequence from step 564 to step 565 analogous to the sequence from step 523 to step 530 is executed one after another by bypassing step 563. Fastener driving operation is executed by stopping the motor 6 and driving the solenoid 14.

Figure 23:
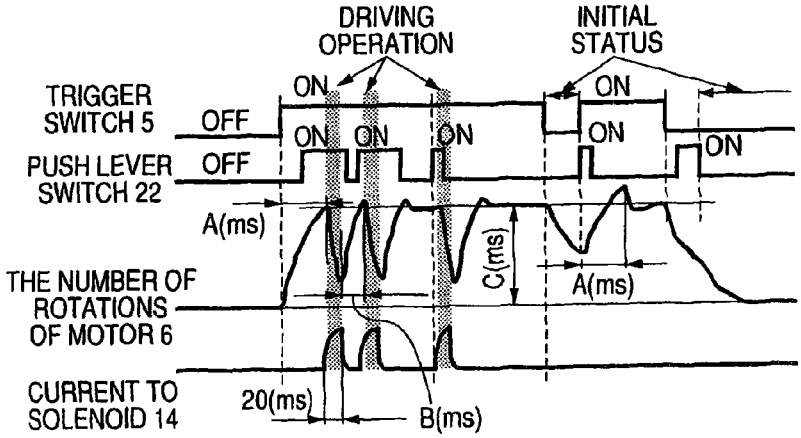
FIG. 23 is a timing chart showing a seventh operation pattern of the electric driving machine shown in FIG. 1.
Figure 24:
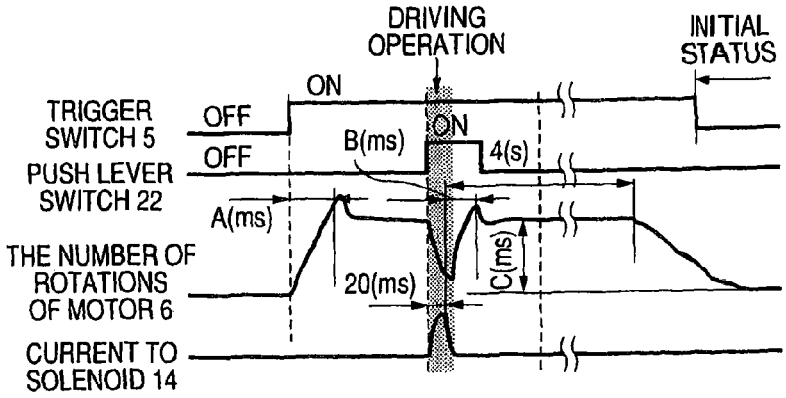
FIG. 24 is a timing chart showing an eighth operation pattern of the electric driving machine shown in FIG. 1.

The operation timing charts shown in FIGS. 23 and 24 show operation conforming to the processing flowchart for the continuous-driving mode.

As is evident from FIG. 23, the continuous-driving mode is characterized in that rotational driving of the motor 6 performed at startup enables driving of a fastener after elapse of the predetermined time A and in that second and subsequent operations for continually driving a fastener enable rotational driving of the motor 6 within the period of predetermined time B that is shorter than the period of predetermined time A after completion of the previous fastener driving operation. The continuous-driving mode is also characterized in that speed control of the motor 6 performed after elapse of the predetermined time A for rotational driving operation at startup or elapse of the predetermined time B (B<A) for second or subsequent rotational driving operations corresponds to constant-speed control. As a result, shortening of operation time and a reduction in the amount of energy in the battery pack consumed are attained, which in turn enhances working efficiency and the utilization factor of energy in the battery pack.

When the trigger switch 5 is deactivated by processing pertaining to step 559 and step 562, rotation of the motor 6 is stopped. When the trigger switch 5 and the push lever switch 22 are deactivated, processing returns to step 566 in the initial state by bypassing step 532.

Figure 25:
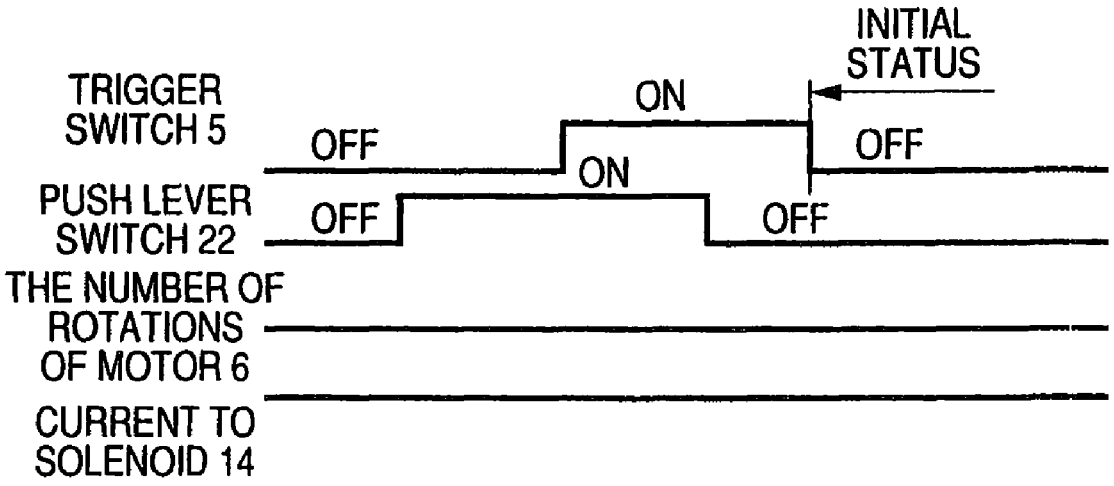
FIG. 25 is a timing chart showing a ninth operation pattern of the electric driving machine shown in FIG. 1.

In the case of the continuous-driving mode as indicated by the operation timing chart shown in FIG. 25, even when the push lever switch 22 and the trigger switch 5 are actuated in the sequence in step 567, driving of the motor 6, the actuation of the solenoid 14, and fastener driving operation are not performed.

When the push lever switch 22 is toggled from the ON state to the OFF state after the motor 6 has been driven as a result of actuation of the trigger switch 5 and before elapse of the predetermined period of time A (350 milliseconds), constant speed C is performed by PWM pulse control after elapse of the predetermined time A. Subsequently, fastener driving operation is performed, so long as the push lever switch 22 is activated. However, driving operation is continued even when the push lever switch 22 is deactivated after the solenoid 14 has been activated as a result of stoppage of the motor 6.

<Operation of the Remaining Fastener Sensor 257 and Operation of the Delay Circuit 401>

When the arm 257*a* of the remaining fastener sensor (a microswitch) 257 has detected a paucity of remaining fasteners after completion of driving of one fastener in the single-driving mode or the continuous-driving mode, the remaining fastener sensor 257 is activated. As a result of this activating operation, the capacitor 253 constituting the delay circuit 401 is discharged by the remaining fastener sensor 257 by way of the resistor 254, and an input voltage of the noninverting input terminal (+) of the operational amplifier 256 becomes lower than an input voltage of the inverting input terminal (−) of the same. Accordingly, the output terminal of the operational amplifier 256 is inverted from an output of level 1—which has been achieved thus far—to an output of level 0. Concurrently with illumination of the LED 249 serving as the remaining fastener indicator, the base current is not supplied to the transistors 298 and 283, and hence these transistors enter an OFF state. Consequently, the first switching element 272 and the second switching element 295 are not supplied with the gate voltage and, therefore, remain in the OFF state. The motor 6 and the solenoid 14 are deactivated, and fastener driving operation is halted.

At this time, it may also be the case where, when the remaining fastener sensor 257 undergoes an impact, a recoil, or other physical forces, resulting from driving operation during the course of the electric driving machine 100 driving a fastener, a movable contact segment of the microswitch (257) causes vibration, to thus effect unwanted activation for a short period of time. Further, there may also arise the case where depletion of a fastener is detected during the course of driving of a fastener. Therefore, the delay circuit 401 is added so as to immediately prevent initiation or stoppage of unwanted driving operation in response to such inadvertent activation of the remaining fastener sensor 257 or activation of the remaining fastener 257 during the course of driving operation. An electrical discharge time constant determined by the capacitor 253 and the resistor 254 of the delay circuit 401 is determined in accordance with a period of time during which the driver blade 3*a* drives a fastener and a natural oscillation period of the movable contact segment of the microswitch sensor (257) constituting the remaining fastener sensor. The electrical discharge time constant is set to; for instance, 150 milliseconds. By the delay function or attenuation function of this delay circuit 401, there is prevented supply of a ground potential to the noninverting input terminal (+) of the operational amplifier 256, which would otherwise be caused by inadvertent activation of the remaining fastener sensor 257. Moreover, in order to prevent occurrence of an abrupt decrease in the input voltage of the noninverting input terminal (+) even when the remaining fastener sensor 257 has become activated during driving operation upon detection of a paucity of remaining fasteners, the fastener driving operation which is now being performed is not aborted or hindered immediately.

As is obvious from the fastener driving operation in a single driving mode of the above-described embodiment, an electric driving machine 100 comprises a motor 6 for rotating a flywheel 9; actuator feeding means 3*c* which converts rotational drive force of the flywheel 9 into rectilinear drive force and transmits the rectilinear drive force to a driver blade 3*a* which drives a fastener; a power transmission section 10, 13, and 12 for transmitting the rotational drive force of the flywheel 9 to the actuator feeding means 3*c* or interrupting transmission of the rotational drive force; engagement/disengagement means 14 for controlling the power transmission section in an engaged status or a disengaged status; a battery pack 7 provided as a source for supplying electric power to the motor 6 and the engagement/disengagement means 14; a trigger switch 5 and a push lever switch 22 which can be actuated so as to be switched from one switch status (e.g., an OFF status) to another switch status (e.g., an ON status); and a controller 50 which controls supply of power from the batter pack 7 to the motor 6 and the engagement/disengagement means 14 in response to switching of the trigger switch 5 and the push lever switch 22, thereby enabling the driver blade 3*a* to drive a fastener, wherein the controller 50 has a single-driving mode/continuous-driving mode changeover switch 233 for performing fastener driving operation in a single driving mode or a continuous driving mode; and, in a case where the single-driving mode/continuous-driving mode changeover switch 233 instructs a single driving mode, the controller 50 causes the driver blade 3*a* to perform fastener driving operation when both the trigger switch 5 and the push lever switch 22 are switched, by switching operation, from the one switch status to the other switch status (e.g., the ON status). Consequently, quick driving operation for driving a fastener at a desired time becomes feasible regardless of sequence of actuation of the trigger switch 5 and the push lever switch 22. Further, aiming operation for accurately driving a fastener to a target location on a workpiece becomes possible. Accordingly, fastener driving operation conforming to a working style can be performed, which yields an advantage of enhancement of working efficiency.

The embodiment of the present invention provided above has described the case where nails are taken as a fastener in a driving machine. However, the present invention can yield advantages analogous to those yielded by the previously-described driving machine even when being applied to a driving machine which drives a fastener other than nails, such as staples (C-shaped nails), screws, or the like, by the force of impact.

Although the invention conceived by the present inventors has been specifically described by reference to the embodiment, the present invention is not limited to the embodiment and susceptible to various modifications within the scope of the gist of the invention.

The invention claimed is:

1. An electric driving machine comprising:

a main body housing including a fastener driving section at one end thereof;

an actuator disposed in the main body housing and configured to linearly move to drive a fastener fed to the fastener driving section;

a motor disposed in the main body housing;

a flywheel mechanically coupled to the motor and configured to be rotated by the motor;

an actuator feeding mechanism configured to linearly drive the actuator in response to rotation of the flywheel;

an engaging unit configured to engage the flywheel with the actuator feeding mechanism and disengage the flywheel from the actuator feeding mechanism;

a trigger switch provided at a handle housing coupled to the main body housing and configured to be operated when driving the fastener;

a push lever switch provided at a leading end of the fastener driving section and configured to be turned on when the fastener driving section is pushed down against a workpiece;

a first switching element configured to toggle power supply to the motor;

a second switching element configured to toggle power supply to the engaging unit; and a controller configured to control the first and second switching elements on and off, wherein:

even if the push lever switch is not turned on, the controller controls the first switching element so as to supply power to the motor when the trigger switch is turned on, if the push lever switch is turned on at the time that an on state of the trigger switch lasts a predetermined time or the push lever switch is turned on after the predetermined time has passed and before a predetermined limiting time has passed since the trigger switch is turned on, wherein the predetermined limiting time is longer than the predetermined time, the controller controls the second switching element to supply power to the engaging means to engage the flywheel with the actuator feeding mechanism, and if the push lever switch is not turned on after the predetermined limiting time has passed, the controller controls the first switching element to stop supplying the power to the motor.

2. The electric driving machine according to claim 1, wherein, if the push lever switch has been already in the on state at the time that the predetermined time has passed since the trigger switch is turned on, the controller controls the first switching element to stop supplying the power to the motor.

3. The electric driving machine according to claim 1, wherein, if the push lever switch is repeatedly turned on and off while the trigger switch is turned on, the controller controls the second switching element to engage the flywheel with the actuator feeding mechanism.

4. The electric driving machine according to claim 1, wherein the controller stops supplying power to the motor if the push lever switch is turned on, after the predetermined time has passed and before the engaging means engages the flywheel with the actuator feeding mechanism.

* * * * *